US007717682B2

(12) United States Patent
Orr

(10) Patent No.: US 7,717,682 B2
(45) Date of Patent: May 18, 2010

(54) DOUBLE DIAPHRAGM PUMP AND RELATED METHODS

(75) Inventor: Troy J. Orr, Draper, UT (US)

(73) Assignee: Purity Solutions LLC, Draper, UT (US)

( * ) Notice: Subject to any disclaimer, the term of this patent is extended or adjusted under 35 U.S.C. 154(b) by 801 days.

(21) Appl. No.: 11/484,061

(22) Filed: Jul. 11, 2006

(65) Prior Publication Data

US 2007/0077156 A1 Apr. 5, 2007

Related U.S. Application Data

(60) Provisional application No. 60/699,262, filed on Jul. 13, 2005.

(51) Int. Cl.
*F04B 45/053* (2006.01)
*F04B 9/109* (2006.01)
*F04B 23/04* (2006.01)

(52) U.S. Cl. ..... 417/395; 417/507; 417/533

(58) Field of Classification Search ..... 417/322, 417/394, 395, 507, 521, 533
See application file for complete search history.

(56) References Cited

U.S. PATENT DOCUMENTS

| | | | | | |
|---|---|---|---|---|---|
| 2,383,193 | A | | 8/1945 | Herbert | 103/152 |
| 2,529,028 | A | | 11/1950 | Landon | 210/40 |
| 2,711,134 | A | * | 6/1955 | Hughes | 417/395 |
| 2,755,745 | A | * | 7/1956 | Lewis | 417/379 |
| 2,871,795 | A | * | 2/1959 | Smith | 417/534 |
| 3,741,687 | A | | 6/1973 | Nystroem | 417/317 |
| 4,047,844 | A | | 9/1977 | Robinson | 417/3 |
| 4,158,530 | A | | 6/1979 | Bernstein | 417/389 |
| 4,412,553 | A | | 11/1983 | Kopp et al. | 137/118.06 |
| 4,479,760 | A | | 10/1984 | Bilstad et al. | 417/395 |
| 4,479,761 | A | | 10/1984 | Bilstad et al. | 417/395 |
| 4,583,920 | A | | 4/1986 | Lindner | 417/266 |
| 4,657,490 | A | | 4/1987 | Abbott | 417/478 |
| 4,690,621 | A | | 9/1987 | Swain | |
| 4,858,883 | A | | 8/1989 | Webster | 251/61.1 |
| 4,974,754 | A | | 12/1990 | Wirz | |
| 5,088,515 | A | | 2/1992 | Kamen | 137/15.17 |
| 5,259,352 | A | | 11/1993 | Gerhardy et al. | 123/509 |
| 5,342,182 | A | | 8/1994 | Montoya et al. | 417/477.1 |
| 5,344,292 | A | * | 9/1994 | Rabenau et al. | 417/413.1 |
| 5,413,626 | A | | 5/1995 | Bartsch | 95/219 |
| 5,431,626 | A | | 7/1995 | Bryant et al. | 604/65 |
| 5,573,385 | A | | 11/1996 | Chevallier | 417/393 |
| 5,588,816 | A | * | 12/1996 | Abbott et al. | 417/479 |
| 5,593,290 | A | | 1/1997 | Greisch et al. | 417/478 |
| 5,669,764 | A | | 9/1997 | Behringer et al. | 417/395 |
| 5,718,567 | A | | 2/1998 | Rapp et al. | 417/395 |
| 5,902,096 | A | | 5/1999 | Behringer et al. | 417/395 |
| 5,934,885 | A | | 8/1999 | Farrell et al. | 417/392 |
| 5,938,634 | A | | 8/1999 | Packard | 604/29 |
| 6,079,959 | A | | 6/2000 | Kingsford et al. | 417/393 |
| 6,106,246 | A | | 8/2000 | Steck et al. | 417/395 |

(Continued)

*Primary Examiner*—Devon C Kramer
*Assistant Examiner*—Bryan Lettman
(74) *Attorney, Agent, or Firm*—Stoel Rives LLP

(57) ABSTRACT

A pump for transferring a process fluid has a first pump chamber and a second pump chamber. A motive fluid actuates the pump chambers and control flow valves. The direction of process fluid flow is controlled by varying the amounts of pressure or the use of a vacuum. The control flow valves utilize diaphragms for actuation.

17 Claims, 16 Drawing Sheets

U.S. PATENT DOCUMENTS

| | | | | |
|---|---|---|---|---|
| 6,152,705 | A | 11/2000 | Kennedy et al. | 417/395 |
| 6,168,394 | B1 | 1/2001 | Forman et al. | 417/395 |
| 6,206,644 | B1 | 3/2001 | Pereira et al. | 417/53 |
| 6,227,824 | B1 | 5/2001 | Stehr | 417/540 |
| 6,229,753 | B1 | 5/2001 | Kono et al. | 365/230.03 |
| 6,286,566 | B1 | 9/2001 | Cline et al. | 141/83 |
| 6,367,669 | B1 | 4/2002 | Au et al. | 222/504 |
| 6,402,486 | B1 | 6/2002 | Steck et al. | 417/395 |
| 6,481,980 | B1 | 11/2002 | Vandlik et al. | |
| 6,579,253 | B1 | 6/2003 | Burbank et al. | 604/5.01 |
| 6,604,908 | B1 | 8/2003 | Bryant et al. | |
| 6,716,004 | B2 | 4/2004 | Vandlik et al. | |
| 6,723,062 | B1 | 4/2004 | Westberg et al. | 604/4.01 |
| 6,752,599 | B2 * | 6/2004 | Park | 417/46 |
| 6,759,007 | B1 | 7/2004 | Westberg et al. | 422/44 |
| 6,905,479 | B1 | 6/2005 | Bouchard et al. | |
| 7,029,245 | B2 | 4/2006 | Maianti et al. | |
| 7,461,968 | B2 * | 12/2008 | Demers et al. | 366/152.1 |
| 2003/0194332 | A1 * | 10/2003 | Jahn et al. | 417/395 |
| 2004/0136843 | A1 * | 7/2004 | Jahn et al. | 417/395 |

* cited by examiner

DOUBLE DIAPHRAGM PUMP AND RELATED METHODS

RELATED APPLICATION

This application claims priority to U.S. Provisional Application Ser. No. 60/699,262 titled DOUBLE DIAPHRAGM PUMP AND RELATED METHODS which was filed on Jul. 13, 2005 for Troy J. Orr. Ser. No. 60/699,262 is hereby incorporated by reference.

TECHNICAL FIELD

The present invention relates generally to the field of fluid transfer. More particularly, the present invention relates to transferring fluids which avoid or at least minimize the amount of impurities being introduced into the fluid.

BRIEF DESCRIPTION OF THE DRAWINGS

Understanding that drawings depict only typical embodiments of the invention and are not therefore to be considered to be limiting of its scope, the invention will be described and explained with additional specificity and detail through the use of the accompanying drawings. The drawings are listed below.

INDEX OF ELEMENTS IDENTIFIED IN THE DRAWINGS

Figure 1:
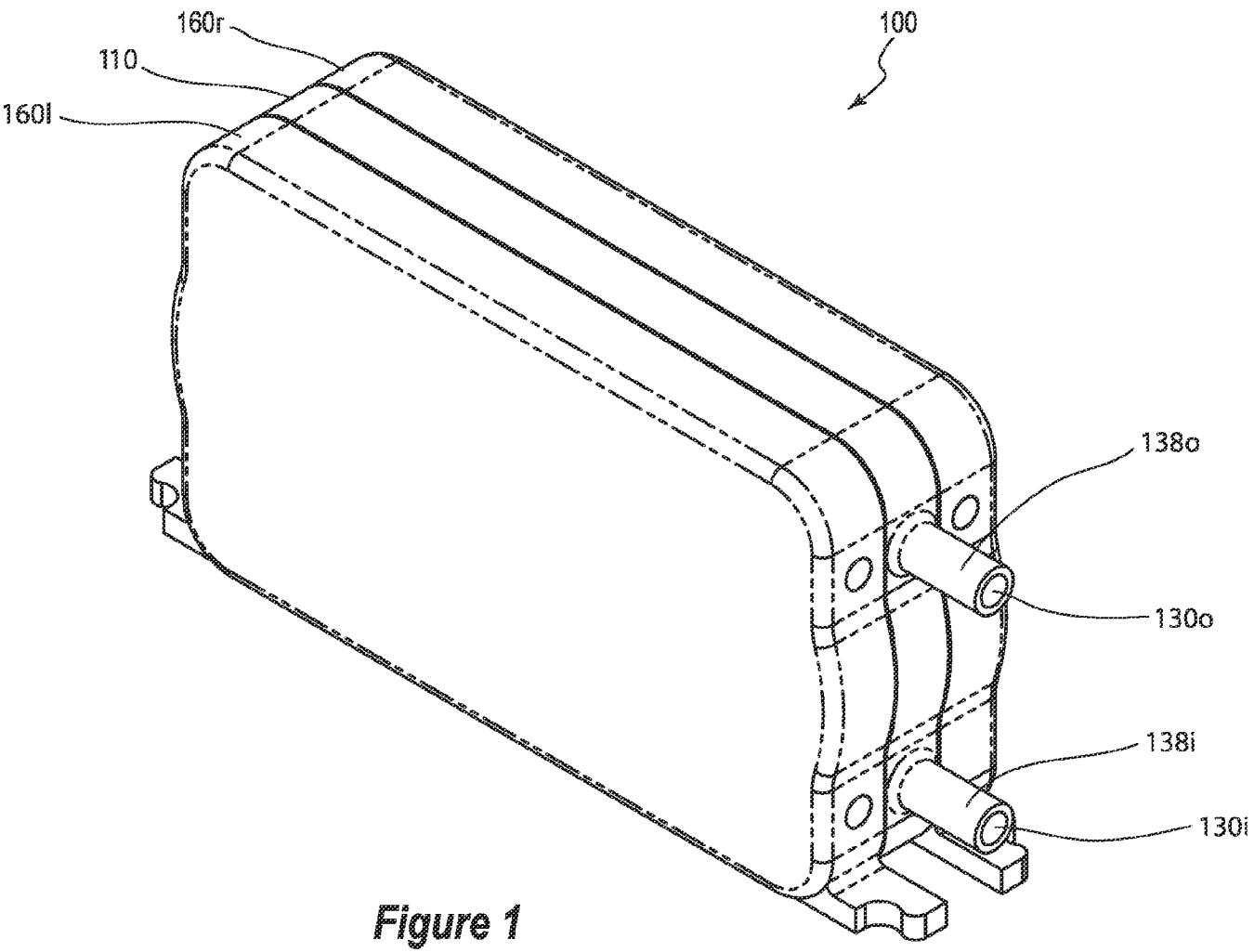
FIG. 1 is a perspective view of the double diaphragm pump.

| Elements numbered in the drawings include: | |
|---|---|
| 100 | double diaphragm pump |
| 101i | first inlet valve chamber |
| 101o | first outlet valve chamber |
| 102i | second inlet valve chamber |
| 102o | second outlet valve chamber |
| 103l | left pump chamber or first pump chamber |
| 103r | right pump chamber or second pump chamber |
| 110 | process fluid body |
| 111i | first inlet valve seat |
| 111o | first outlet valve seat |
| 112i | second inlet valve seat |
| 112o | second outlet valve seat |
| 113l | left pump chamber cavity or first pump chamber cavity |
| 113r | right pump chamber cavity or second pump chamber cavity |
| 114l | surface of left pump chamber 113l |
| 114r | surface of right pump chamber cavity 113r |
| 115l | inclined region of left pump chamber 113l |
| 115r | inclined region of right pump chamber cavity 113r |
| 116l | rim of left pump chamber 113l |
| 116r | rim of right pump chamber cavity 113r |
| 117l | perimeter of left pump chamber cavity 113l |
| 117r | perimeter of right pump chamber cavity 113r |
| 118i | perimeter of first inlet valve seat 111i |
| 118o | perimeter of first outlet valve seat 111o |
| 119i | perimeter of second inlet valve seat 112i |
| 119o | perimeter of second outlet valve seat 112o |
| 121i | groove of first inlet valve seat 111i |
| 121o | groove of first outlet valve seat 111o |
| 122i | groove of second inlet valve seat 112i |
| 122o | groove of second outlet valve seat 112o |
| 130i | inlet line |
| 130o | outlet line |
| 131i | first inlet valve portal for fluid communication between inlet line 130i and first inlet valve seat 111i |
| 131o | first outlet valve portal for fluid communication between first outlet valve seat 111o and outlet line 130o |
| 132i | second inlet valve portal for fluid communication between inlet line 130i and second inlet valve seat 112i |
| 132o | second outlet valve portal for fluid communication between second outlet valve seat 112o and outlet line 130o |
| 138i | inlet line extension |
| 138o | outlet line extension |
| 141i | seat rim of first inlet valve seat 111i |
| 141o | seat rim of first outlet valve seat 111o |
| 151i | chamber channel for fluid communication between left pump chamber cavity 113l and first inlet valve seat 111i |
| 151o | chamber channel for fluid communication between left pump chamber cavity 113l and first outlet valve seat 111o |
| 152i | chamber channel for fluid communication between right pump chamber cavity 113r and second inlet valve seat 112i |
| 152o | chamber channel for fluid communication between right pump chamber cavity 113r and second outlet valve seat 112o |
| 156 | transverse segment of manifold A in process fluid body 110 |
| 157 | transverse segment of manifold B in process fluid body 110 |
| 160l | left motive fluid plate |
| 160r | right motive fluid plate |
| 161i | transfer passage of manifold A between actuation cavity 171i of first outlet valve 101i and segment 168r |
| 161o | transfer passage of manifold B between actuation cavity 171o of first outlet valve 101o and segment 164r |
| 162i | transfer passage of manifold B between actuation cavity 172i of second inlet valve 102i and segment 168l |

-continued

Elements numbered in the drawings include:

| | |
|---|---|
| 162o | transfer passage of manifold A between actuation cavity 172o of second outlet valve 102o and segment 164l |
| 163l | transfer passage of manifold A between actuation cavity 173l of left pump chamber 103l and segment 164l |
| 163r | transfer passage of manifold B between actuation cavity 173r of left pump chamber 103r and segment 164r |
| 164l | segment of manifold A |
| 164r | segment of manifold B |
| 165l | segment of manifold A |
| 165r | segment of manifold B |
| 166l | segment of manifold A |
| 166r | segment of manifold A |
| 167l | segment of manifold B |
| 167r | segment of manifold B |
| 168l | segment of manifold B |
| 168r | segment of manifold A |
| 169l | segment of manifold B |
| 169r | segment of manifold A |
| 171i | actuation cavity of first inlet valve 101i |
| 171o | actuation cavity of first outlet valve 101o |
| 172i | actuation cavity of second inlet valve 102i |
| 172o | actuation cavity of second outlet valve 102o |
| 173l | actuation cavity of left pump chamber 103l |
| 173r | actuation cavity of right pump chamber 103r |
| 181i | recess of first inlet valve 101i |
| 181o | recess of first outlet valve 101o |
| 182i | recess of second inlet valve 102i |
| 182o | recess of second outlet valve 102o |
| 183l | recess of left pump chamber 103l |
| 183r | recess of right pump chamber 103r |
| 184 | cavity surface |
| 185l | inclined region |
| 186l | rim |
| 187l | perimeter linear recess features |
| 188 | circular recess features |
| 191i&o | o-rings |
| 192i&o | o-rings |
| 193r&l | o-rings |
| 199r&l | plugs |
| 266r&l | o-rings |
| 267r&l | o-rings |
| 256r&l | holes in the integrated diaphragm media |
| 257r&l | holes in the integrated diaphragm media |
| 270l | left integrated diaphragm media |
| 270r | right integrated diaphragm media |
| 271i | first inlet valve region of right integrated diaphragm media 270r |
| 271o | first outlet valve region of right integrated diaphragm media 270r |
| 272i | second inlet valve region of left integrated diaphragm media 270l |
| 272o | second outlet valve region of left integrated diaphragm media 270l |
| 273l | first pump chamber region of left integrated diaphragm media 270r |
| 273r | second pump chamber region of right integrated diaphragm media 270r |
| 300 | forming fixture |
| 310 | first plate |
| 320 | chamber region face |
| 322 | o-ring groove |
| 324 | portal |
| 326 | perimeter of chamber region face |
| 330a-b | valve region faces |
| 332a-b | o-ring grooves |
| 334a-b | portals |
| 336a-b | perimeters of valve region faces |
| 340 | second plate |
| 350 | chamber region recess |
| 352 | recess surface |
| 354 | portal |
| 356 | lip |
| 358 | rim portion |
| 360a-b | valve region recesses |
| 362a-b | recess surfaces |
| 364a-b | portals |
| 366a-b | lips |
| 368a-b | rim portions |

DETAILED DESCRIPTION OF PREFERRED EMBODIMENTS

Figure 5:
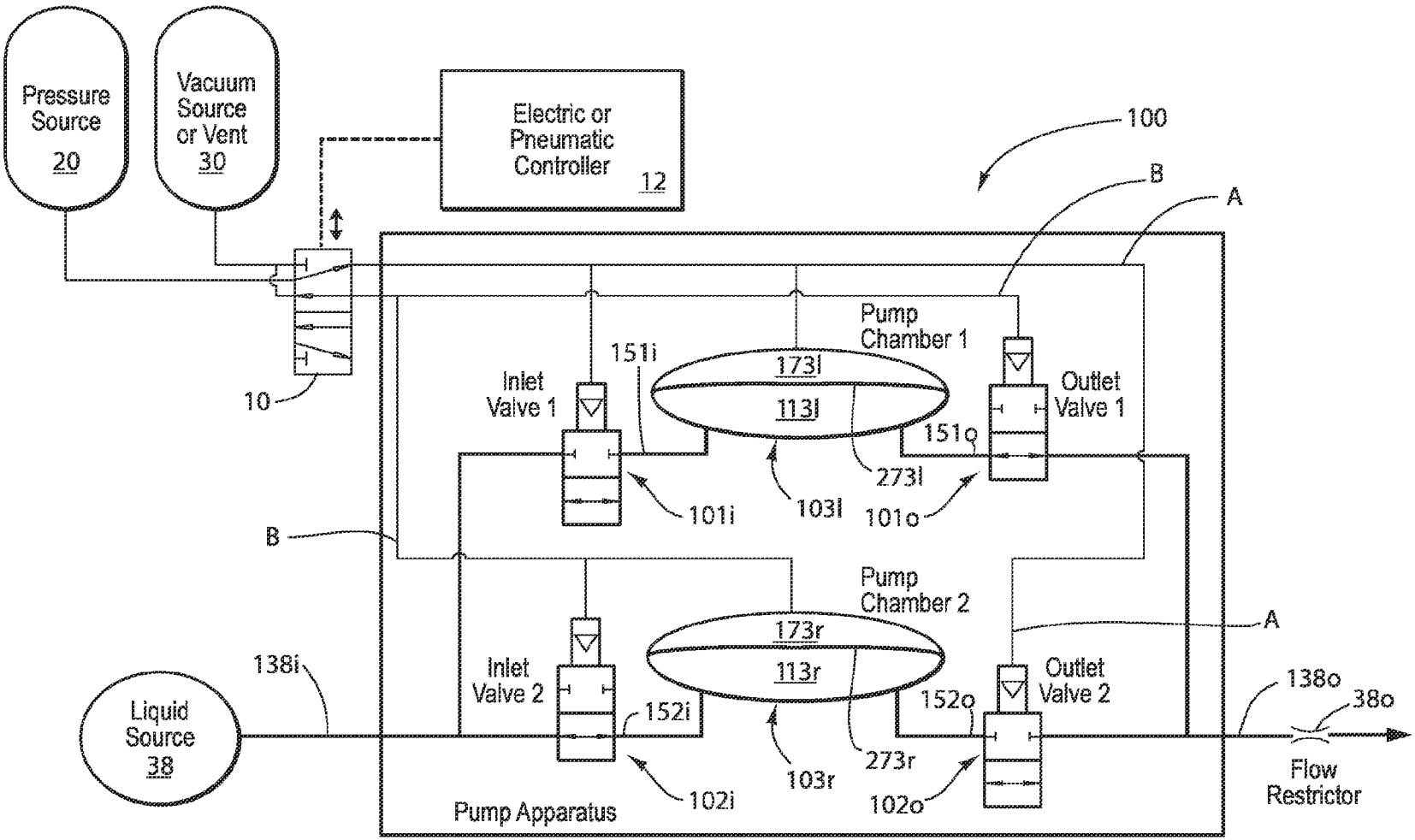
FIG. 5 is a schematic view of a double diaphragm pump as used in a method and system for transferring fluid. The system has a single pressure/vacuum valve.

The inventions described hereinafter relate to a pump apparatus and related methods and systems. FIG. 5 provides a schematic view of one embodiment of a system utilizing the double diaphragm pump. Another embodiment of a double diaphragm pump and another embodiment of a system which utilizes the pump are shown in the schematic view provided in FIG. 7. FIGS. 9A-9B and FIGS. 10A-10D relate to an embodiment of a forming fixture used to shape regions of a diaphragm media which is used in the pump.

The pump enables fluids to be transferred in a wide variety of fields. For example, the pump can be used in the transfer of high purity process fluids which may be corrosive and/or caustic in the manufacture of semiconductor chips. The pump is advantageous in transferring high purity process fluids as the pump avoids or at least minimizes the introduction or generation of contaminants or particulate matter that can be transferred downstream by reducing or eliminating rubbing and sliding components. Downstream transfer of contaminants or particulate matter may eventually damage or contaminate the high-purity finished product such as a semiconductor chip or shorten the durability of filters placed downstream of pumps.

The double diaphragm pump also has medical uses. For example, the pump can be used to move blood. Particulates generated by pumps moving fluids to and from a patient have the potential to create adverse health effects. These include the generation of embolisms or microembolisms in the vascular system and also the toxicity of the materials introduced or generated by the pump. Additionally, using a pneumatically actuated diaphragm pump is advantageous because of the inherent control of delivering fluids within biologically acceptable pressure ranges. If a blockage occurs in the process fluid connection lines to the pump, the pump will only generate pressure in the process fluid at or near the pneumatic supply pressures driving the pump. In the case of pumping blood, excessive pressures or high vacuums can damage blood or cause air embolisms.

Figure 2:
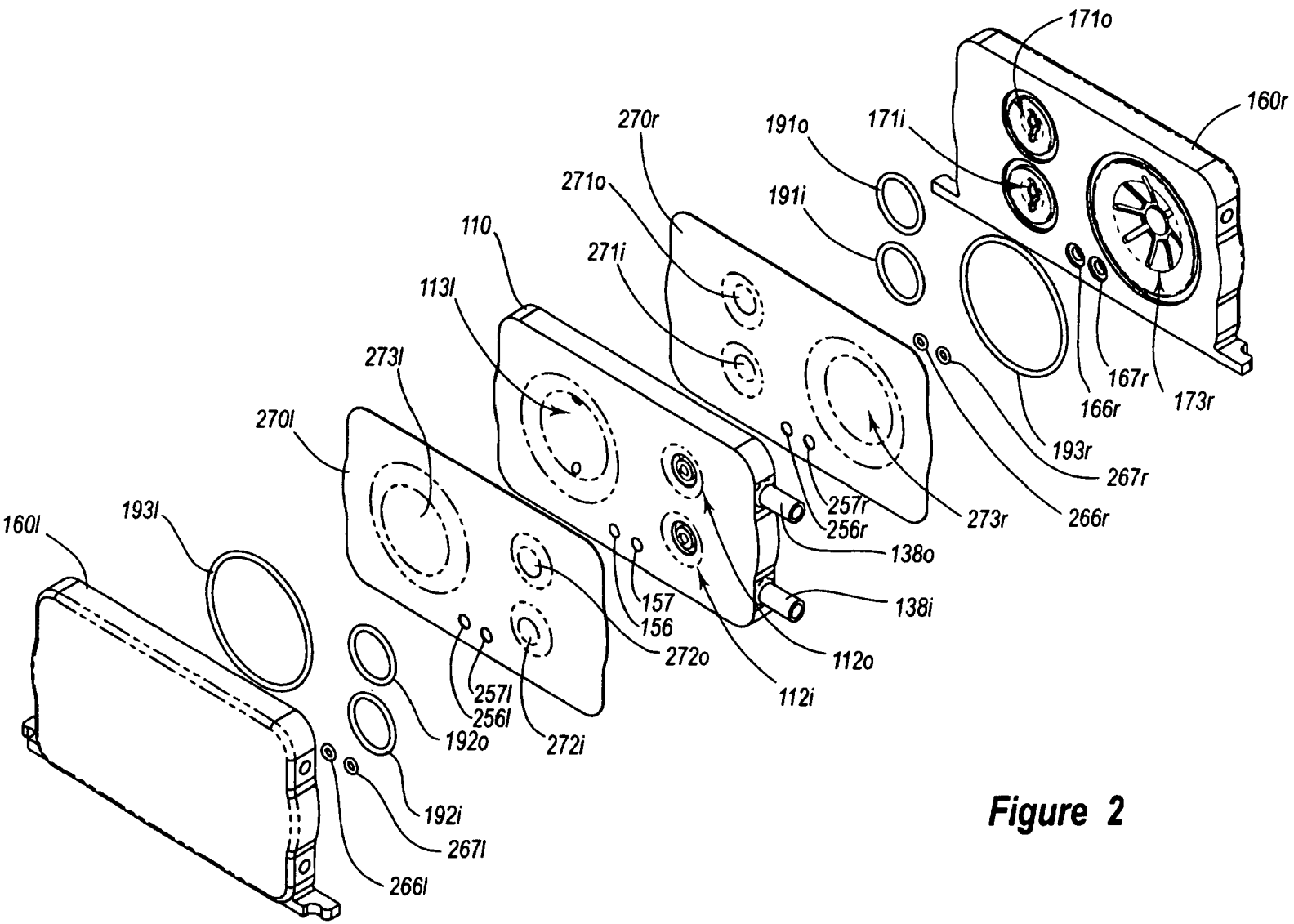
FIG. 2 is an exploded perspective view of the double diaphragm pump.

FIG. 1 provides a perspective of one embodiment of a double diaphragm pump at 100. FIG. 1 also shows process fluid body 110, left motive fluid plate 160*l* and right motive fluid plate 160*r*. The integrated diaphragm media between process fluid body 110 and each of the plates are not shown in FIG. 1 but are shown in FIG. 2 and FIGS. 4B-4C. While the integrated diaphragm media do not necessarily extend to the perimeter of process fluid body 110, plate 160*l* and plate 160*r*, in an another embodiment the media can extend to the perimeter or beyond so that the media protrudes.

FIG. 1 also shows features related to the inlet and outlet lines for the process fluid in process fluid body 110. In particular, inlet line 130*i* within inlet line extension 138*i* and outlet line 130*o* within outlet line extension 138*o* are shown. Line 130*i* and line 130*o* are shown in more detail in FIG. 3B, FIGS. 4B-4C and FIG. 4F. In this embodiment, connections to external process fluid lines can be made to the inlet line extension 138*i* and outlet line extension 138*o*.

Some of the components which comprise the valve chambers and the pump chambers are shown in FIG. 2, however, the chambers are not identified in FIG. 2 as it is an exploded perspective view. The chambers are identified in FIGS. 4B-4C, FIGS., 4E-4G, FIG. 5 and FIG. 7. The chambers include first inlet valve chamber 101*i*, first outlet valve chamber 101*o*, second inlet valve chamber 102*i*, second outlet valve chamber 102*o*, left pump chamber or first pump chamber 103*l*, and right pump chamber or second pump chamber

103*r*. Assembling the components together shown in FIG. 2 can be done by mechanical fasteners such as nuts and bolts, clamps, screws, etc.; adhesives; welding; bonding; or other mechanisms. These mechanisms are all examples of means for maintaining the plates and body together and sealing chambers created between the plates and body.

FIG. 2 provides the best view of left integrated diaphragm media 270*l* and right integrated diaphragm media 270*r*. Each media has a specific region corresponding with a particular chamber. In one embodiment, the regions are pre-shaped. For example, the regions may be pre-shaped by stretching. Of course, each chamber could also use a separate diaphragm that is not integrated instead of a single diaphragm media. Additionally, the separate diaphragms could also be pre-formed or pre-stretched. Methods for forming an integrated diaphragm media with pre-shaped regions is discussed below with reference to FIGS. 9A-9B and FIGS. 10A-10D.

The chamber regions of left integrated diaphragm media 270*l* include second inlet valve region 272*i*, second outlet valve region 272*o* and first pump chamber region 273*l*. The chamber regions of right integrated diaphragm media 270*r* include first inlet valve region of 271*i*, first outlet valve region 271*o* and second pump chamber region 273*r*. Each media also has a hole 256*r* (256*l*) and a hole 257*r* (257*l*) for passage of the motive fluid via manifold A and manifold B. FIG. 2 also shows a plurality of optional o-rings 191*i*, 191*o*, 192*i*, 192*o*, 193*l*, 193*r*, 266*r*, 266*l*, 267*r*, and 267*l* which assist in sealing each valve chamber, pump chamber, and the passages for the motive fluids.

Left/first pump chamber 103*l* is divided by first pump chamber region 273*l* into left pump chamber cavity 113*l* and actuation cavity 173*l*. Similarly, right/second pump chamber 103*r* is divided by second pump chamber region 273*r* into right pump chamber cavity 113*r* and actuation cavity 173*r*. Each of the valve chambers 101*i*, 101*o*, 102*i* and 102*o* are also divided by their respective diaphragm media regions. In particular, valve chambers 101*i*, 101*o*, 102*i* and 102*o* each comprise an actuation cavity and a valve seat. The valve seats include first inlet valve seat 111*i*, first outlet valve seat 111*o*, second inlet valve seat 112*i*, and second outlet valve seat 112*o*. The actuation cavities include actuation cavity 171*i* of first inlet valve 101*i*, actuation cavity 171*o* of first outlet valve 101*o*, actuation cavity 172*i* of second inlet valve 102*i* and actuation cavity 172*o* of second outlet valve 102*o*.

The flow path of the fluids in double diaphragm pump 100 are described below with reference to FIG. 5 and FIG. 7. The flow path is also described with reference to FIGS. 4B-4C. Before providing a comprehensive overview of the flow path, the components of double diaphragm pump 100 are described below with occasional reference to the flow path. However, it should be understood that a process fluid is pumped into and out of left/first pump chamber 103*l* and right/second pump chamber 103*r* so that the fluid enters and exits process fluid body 110. It should also be understood that the different regions of the diaphragm media are moved by alternating applications of pressure and vacuums via a motive fluid in manifold A and manifold B to pump the process fluid into and out of pump chambers 103*l* and 103*r*.

Note that the different regions of the diaphragm media can also be moved by applying a pressure to the motive fluid which is greater than the pressure of the process fluid and alternating with application of pressure of the motive fluid which is less than the pressure of the process fluid. The amount of pressure or vacuum applied can vary significantly depending on the intended use. For example, it may be used to deliver a fluid at a pressure in a range from about 0 psig to about 2000 psig, 1 psig to about 300 psig, 15 psig to 60 psig. Similarly, it may receive fluid from a source or generate suction in a range from about −14.7 psig to about 0 psig or an amount which is less than the pressure of the fluid source. In an embodiment used as a blood pump, it can deliver or receive blood at a pressure ranging from about −300 mmHg to about 500 mmHg.

Figure 3A:
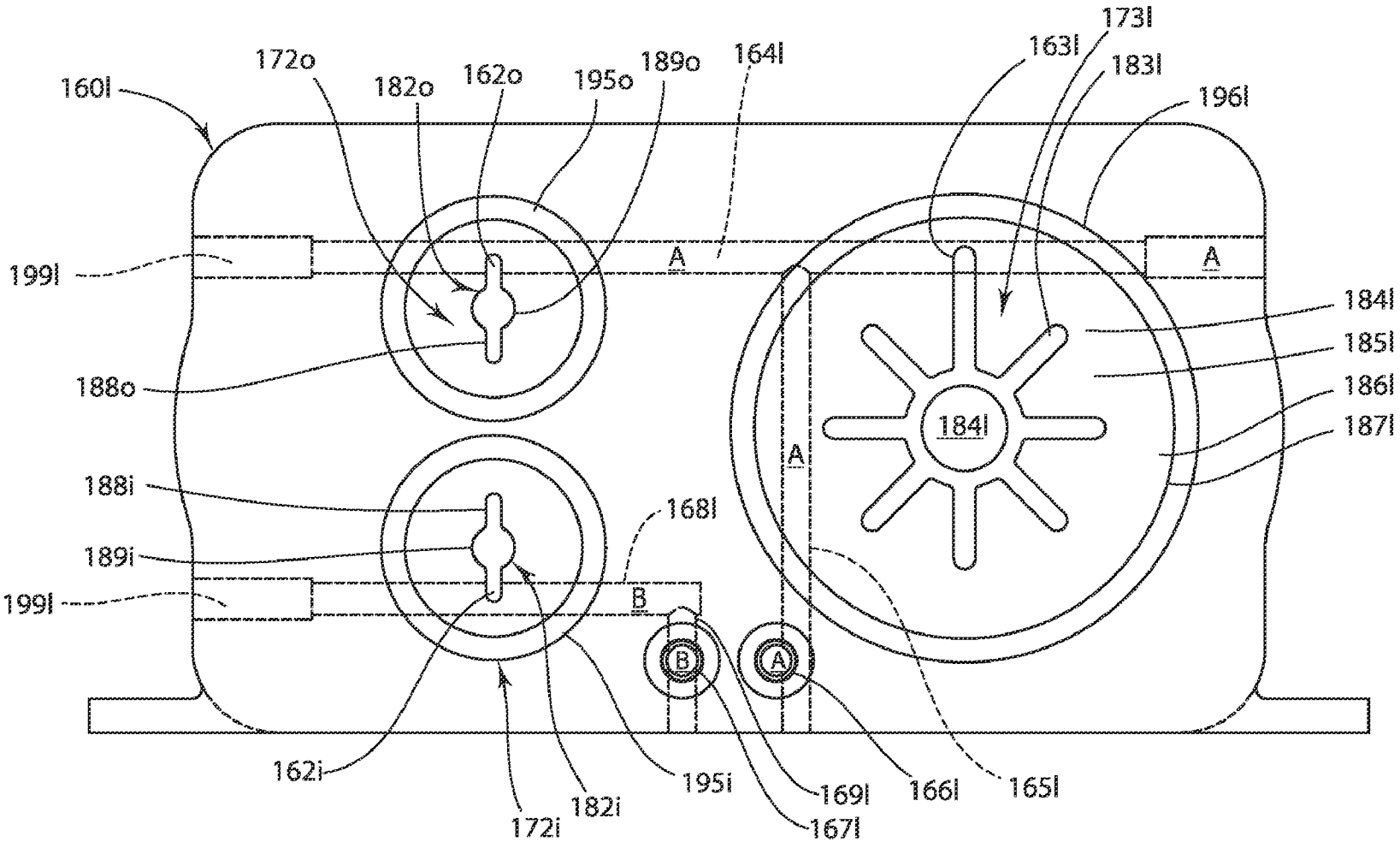
FIG. 3A is a side view of the inner side of the left motive fluid plate with the interior shown in phantom.

FIG. 3A, FIG. 4B, and FIG. 4C shows actuation cavity 172*i* of second inlet valve 102*i*, actuation cavity 172*o* of second outlet valve 102*o* and actuation cavity 173*l* of left pump chamber 103*l*. FIG. 3A also shows portions of manifold A and manifold B. As best understood with reference to FIG. 4B and FIG. 4G, actuation cavity 173*l* is in fluid communication with actuation cavity 172*o* via manifold A. One of the components of manifold A in left motive fluid plate 160*l* is a transfer passage 163*l* for fluid communication between actuation cavity 173*l* of left pump chamber 103*l* and segment 164*l*, which is the long horizontal segment. Another component is a transfer passage 162*o* for fluid communication between actuation cavity 172*o* of second outlet valve 102*o* and segment 164*l*. Other components of manifold A in left motive fluid plate 160*l* comprise segment 165*l*, which is a long vertical segment extending from segment 164*l*, and segment 166*l*, which is a short transverse segment extending from segment 165*l* through left motive fluid plate 160*l*. Other components of manifold A are in process fluid body 110 and right motive fluid plate 160*r*.

In addition to showing the components of manifold A in left motive fluid plate 160*l*, FIG. 3A also shows the components of manifold B in left motive fluid plate 160*l*. As best understood with reference to FIGS. 4B-4C, the manifold B components comprise segments which extend through left motive fluid plate 160*l* and provide fluid communication to each other. These segments are segment 166*l* (not shown) which extends transversely, segment 169*l* which is a short segment extending vertically and transfer passage 162*i* for fluid communication between actuation cavity 172*i* of second inlet valve 102*i* and segment 168*l*.

Actuation cavity 172*i* of second inlet valve 102*i*, actuation cavity 172*o* of second outlet valve 102*o* and actuation cavity 173*l* of left pump chamber 103*l* each have recess configurations which enables the pressure to be rapidly distributed to a large portion of the surface area of the diaphragm region to pressure. These configurations reduce time lags in the response of the diaphragm when switching from a vacuum in one of the manifolds to pressure. For example, actuation cavities 172*i* and 172*o* each have a recess 182*i* and 182*o*. Recesses 182*i* and 182*o* each have a pair of linear recess features opposite from each other which are separated by a circular recess feature. The linear features of recess 182*i* are identified at 188*i* and the circular recess feature is identified at 189*i*. The recess features of recess 182*o* are similarly identified.

Recess 183*l* comprises a plurality of recess features. Recess 183*l* of actuation cavity 173*l* has a larger configuration than recesses 182*i* and 182*o*. Also, cavity surface 184*l* is not just around recess 183*l* but is also at the center of recess 183*l* for wide distribution of the pressure or vacuum. Like actuation cavities 172*i* and 172*o*, actuation cavity 173*l* also has an inclined region as identified at 185*l*. Rim 186*l* and perimeter 187*l*; sealing features 195*i*, 195*o*, and 196*l*; and plugs 199*l* are also identified in FIG. 3A (plugs 199*r* are identified in FIG. 4E).

Figure 3B:
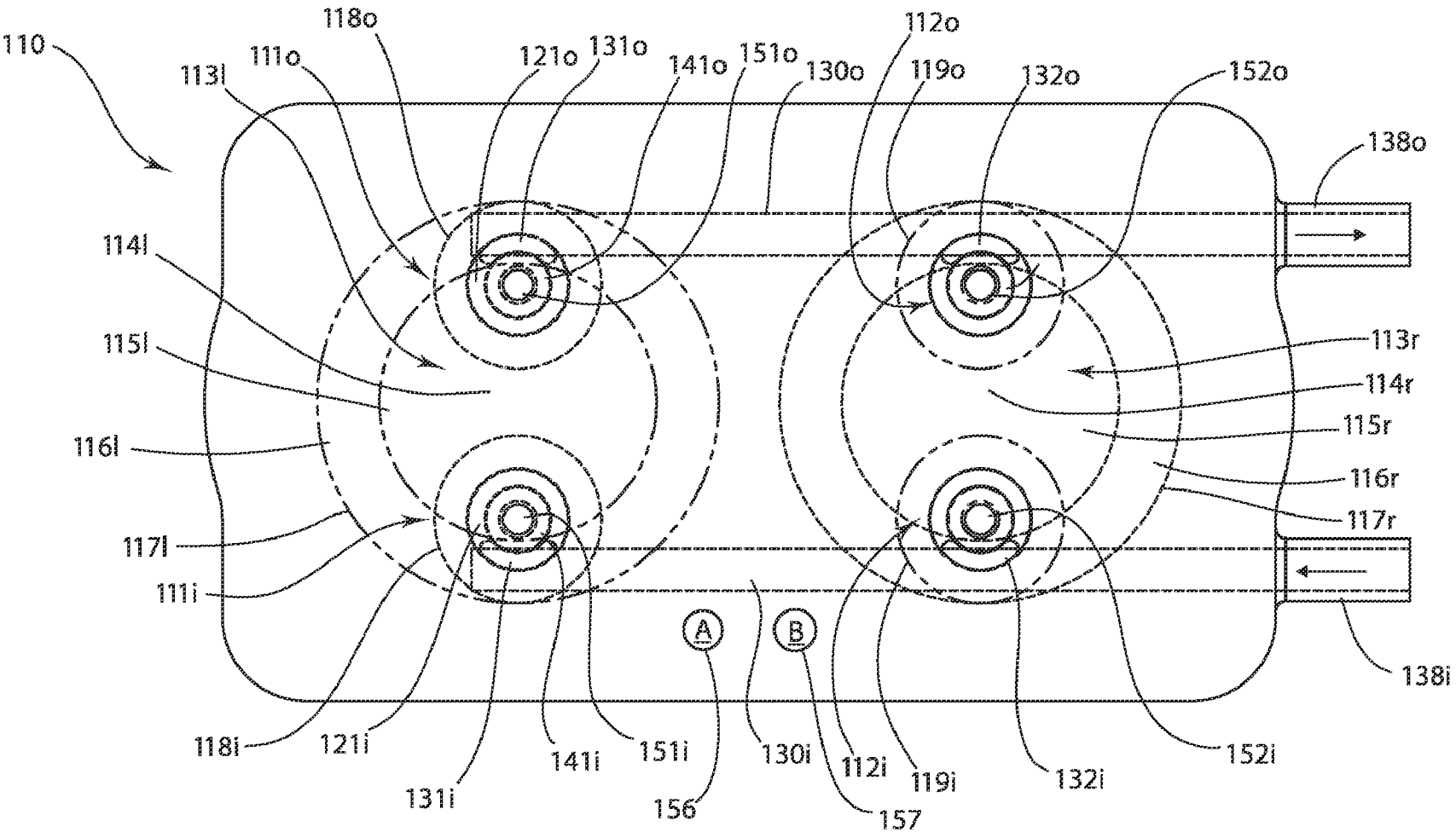
FIG. 3B a side view of process fluid body with the interior shown in phantom.

FIG. 3B shows one side of process fluid body 110 with the other side shown in phantom. Left pump chamber cavity 113*l*, second inlet valve seat 112*i* and second outlet valve seat 112*o* are shown while right pump chamber cavity 113*r*, first inlet valve seat 111*i*, and first outlet valve seat 111*o* are shown in phantom. Each valve seat has a groove 121*i* (121*o*) around a rim 141*i* (141*o*). A valve portal 131*i* (131*o*) provide fluid communication between each valve seat and its corresponding line. For example, inlet line 130*i* which is shown in phantom is in fluid communication with first inlet valve portal 131*i* and second inlet valve portal 132*i*. Similarly, outlet line 130*o* which is also shown in phantom, is in fluid communication with first outlet valve portal 131*o* and second outlet valve portal 132*o*.

Chamber channels 151*i* and 151*o* provide fluid communication respectively with first inlet valve seat 111*i* and left pump chamber cavity 113*l* and with first outlet valve seat 111*o* and left pump chamber cavity 113*l*. Similarly fluid communication with right pump chamber cavity 113*r* between second inlet valve seat 111*i* and second outlet valve seat 112*o* is achieved respectively via chamber channels 152*i* and 152*o*. This configuration permits first inlet valve seat 111*i* and second inlet valve seat 112*i* to be in fluid communication with inlet line 130*i* and to alternatively receive the process fluid. Similarly, first outlet valve seat 111*o* and second outlet valve seat 112*o* are in fluid communication with outlet line 130*o* and alternatively deliver the process fluid.

FIG. 3B also shows other features of the pump chamber cavities 113*l* and 113*r*. The surface of each pump chamber cavity is identified respectively at 114*r* and 114*l* with an inclined region identified at 115*l* and 115*r*. Grooves (not shown) may be incorporated in the pump chamber cavities 113*l* and 113*r* to provide flow channels that enhance the discharge of the process fluid from the pump chambers when the integrated diaphragm media 270*l* and 270*r* is in proximity of the surface of the pump chamber cavities. A rim 116*r* (116*l*) and perimeter 117*r* (117*l*) are also identified. The perimeters of the valve seats are also shown in FIG. 3B. The perimeter of first inlet valve seat 111*i* and the first outlet valve seat 111*o* are respectively identified at 118*i* and 118*o*. The perimeter of second inlet valve seat 112*i* and the second outlet valve seat 112*o* are respectively identified at 119*i* and 119*o*. Note that the transition from the inclined regions to the rims is rounded. These rounded transitions limit the mechanical strain induced in the flexing and possible stretching of the diaphragm regions for a longer cyclic life of the integrated diaphragm media.

FIG. 3B also shows the components of manifolds A & B in process fluid body 110. Segment 156 of manifold A and segment 157 of manifold B both extend transversely through fluid body 110. Segment 156 is in fluid communication with segment 166*l* of left motive fluid plate 160*l* and 166*r* of right motive fluid plate 160*r*. Segment 157 is in fluid communication with segment 167*l* of left motive fluid plate 160*l* and 167*r* of right motive fluid plate 160*r*.

Figure 3C:
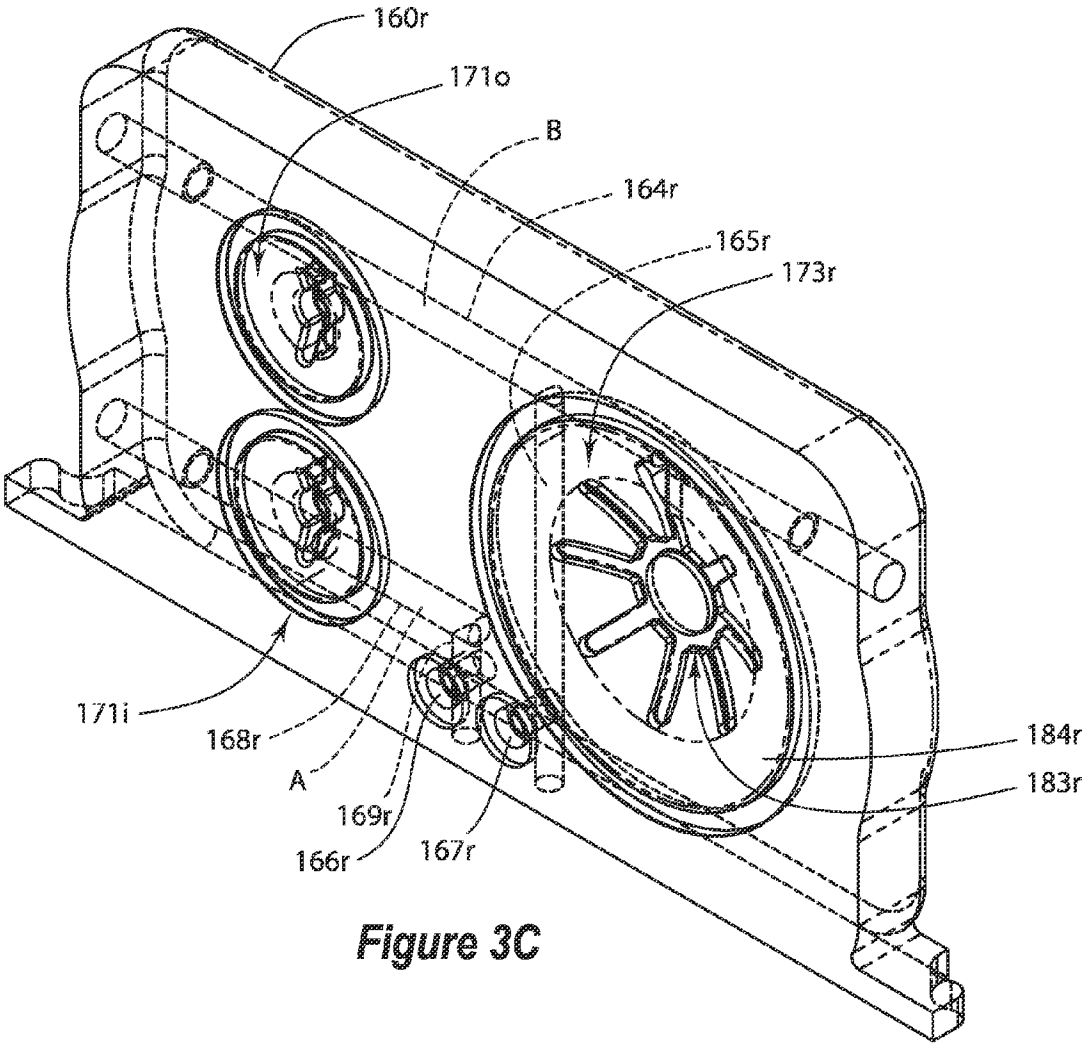
FIG. 3C is a perspective view of the inner side of the right motive fluid plate with the interior shown in phantom.

FIG. 3C is a perspective view of right motive fluid plate 160*r* which shows manifold A and manifold B in phantom. FIG. 3C shows actuation cavity 171*i* of first inlet valve 101*i*, actuation cavity 171*o* of first outlet valve 101*o* and actuation cavity 173*r* of right pump chamber 103*r*. As best understood with reference to FIG. 4B, actuation cavity 173*r* is in fluid communication with actuation cavity 171*o* via manifold B. Right motive fluid plate 160*r* has an identical configuration as left motive fluid plate 160*l* so all of the features of right motive fluid plate 160*r* are not specifically identified in FIG. 3C. Note, however, that the features of right motive fluid plate 160*r* are more specifically identified in FIGS. 4B-4C and FIG. 4E.

Figure 4A:
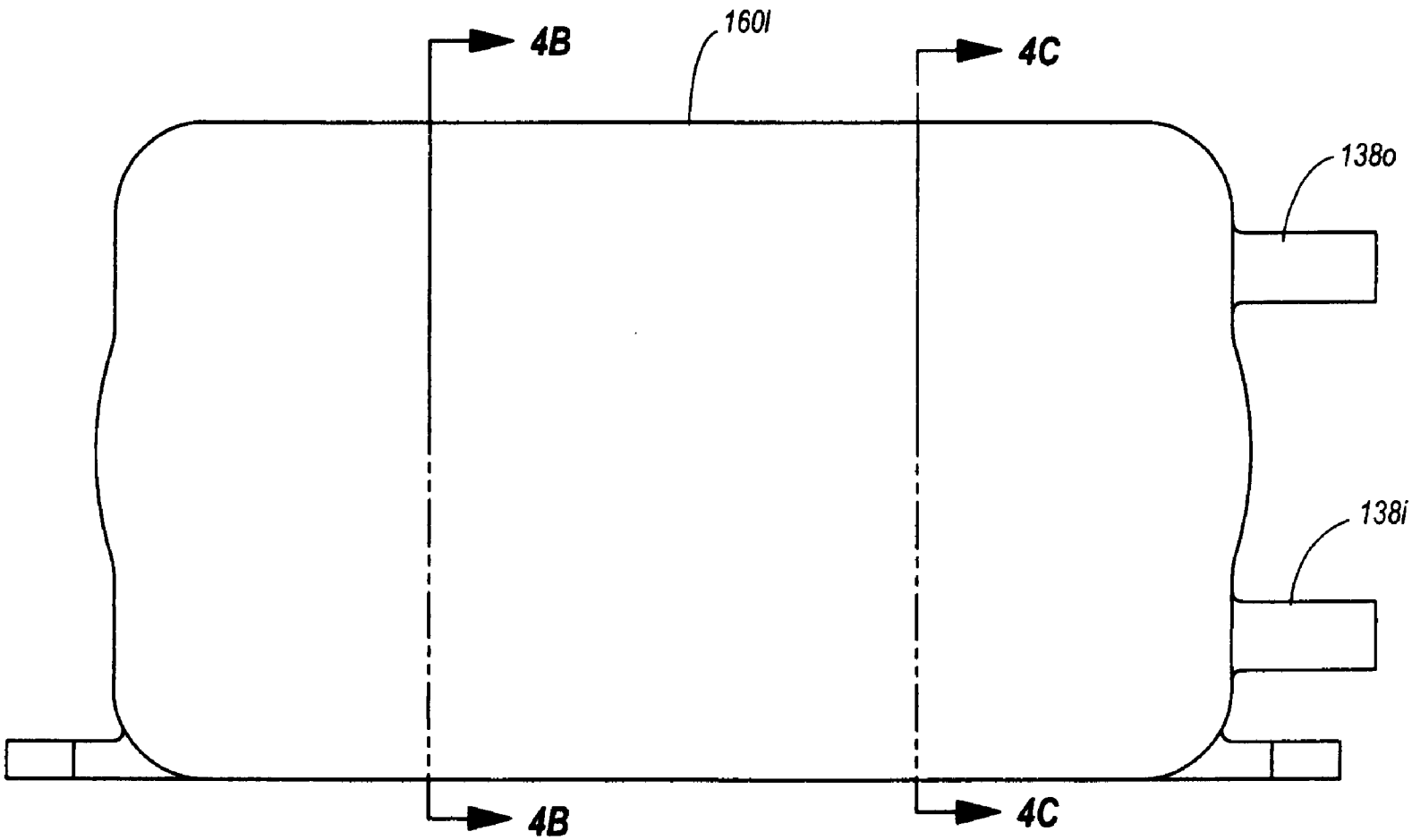
FIG. 4A is a side view of the left motive fluid plate which shows cutting lines 4B-4B and 4C-4C.
Figure 4B:
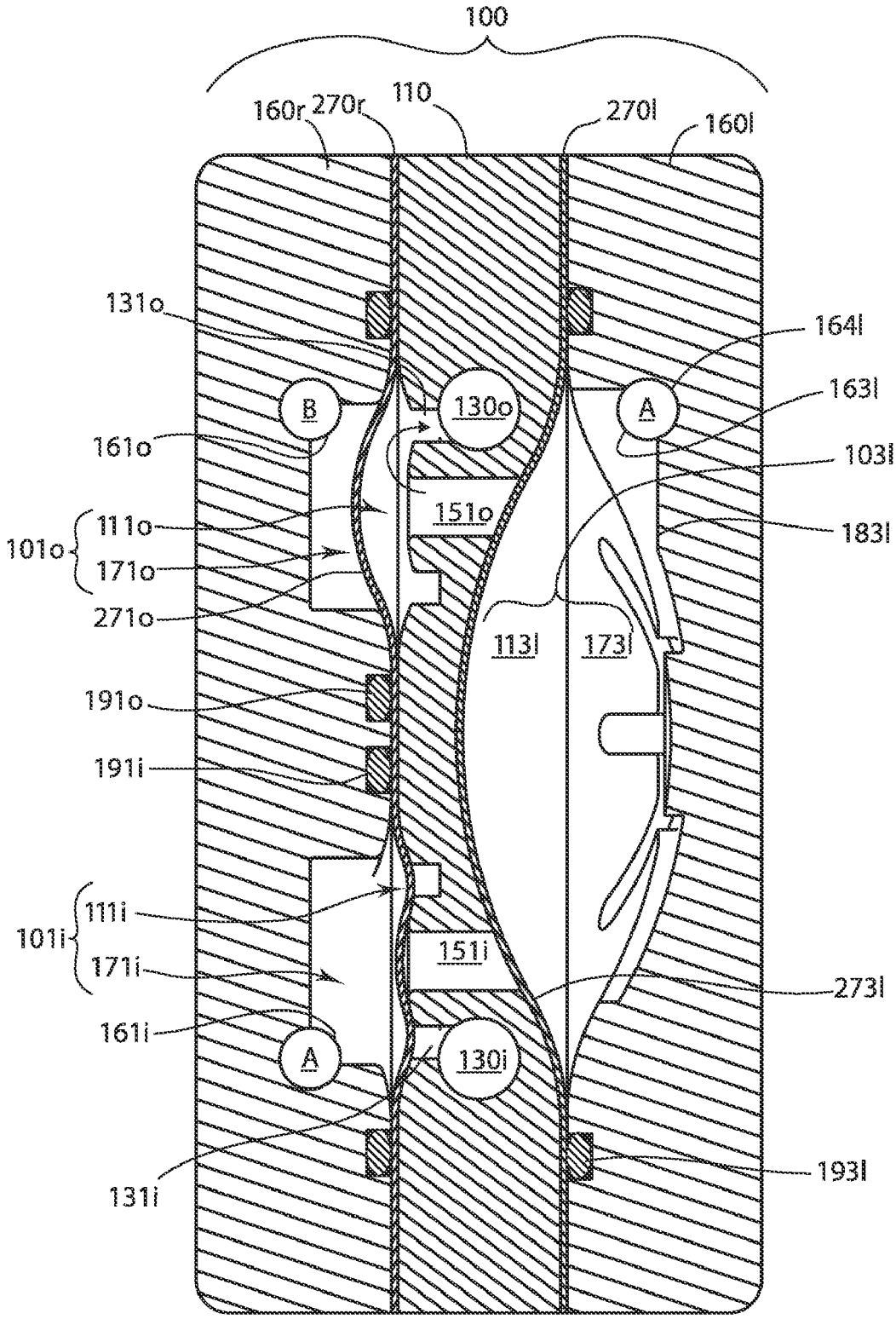
FIG. 4B is a cross-sectional view of the double diaphragm pump taken along cutting line 4B-4B in FIG. 4A.
Figure 4C:
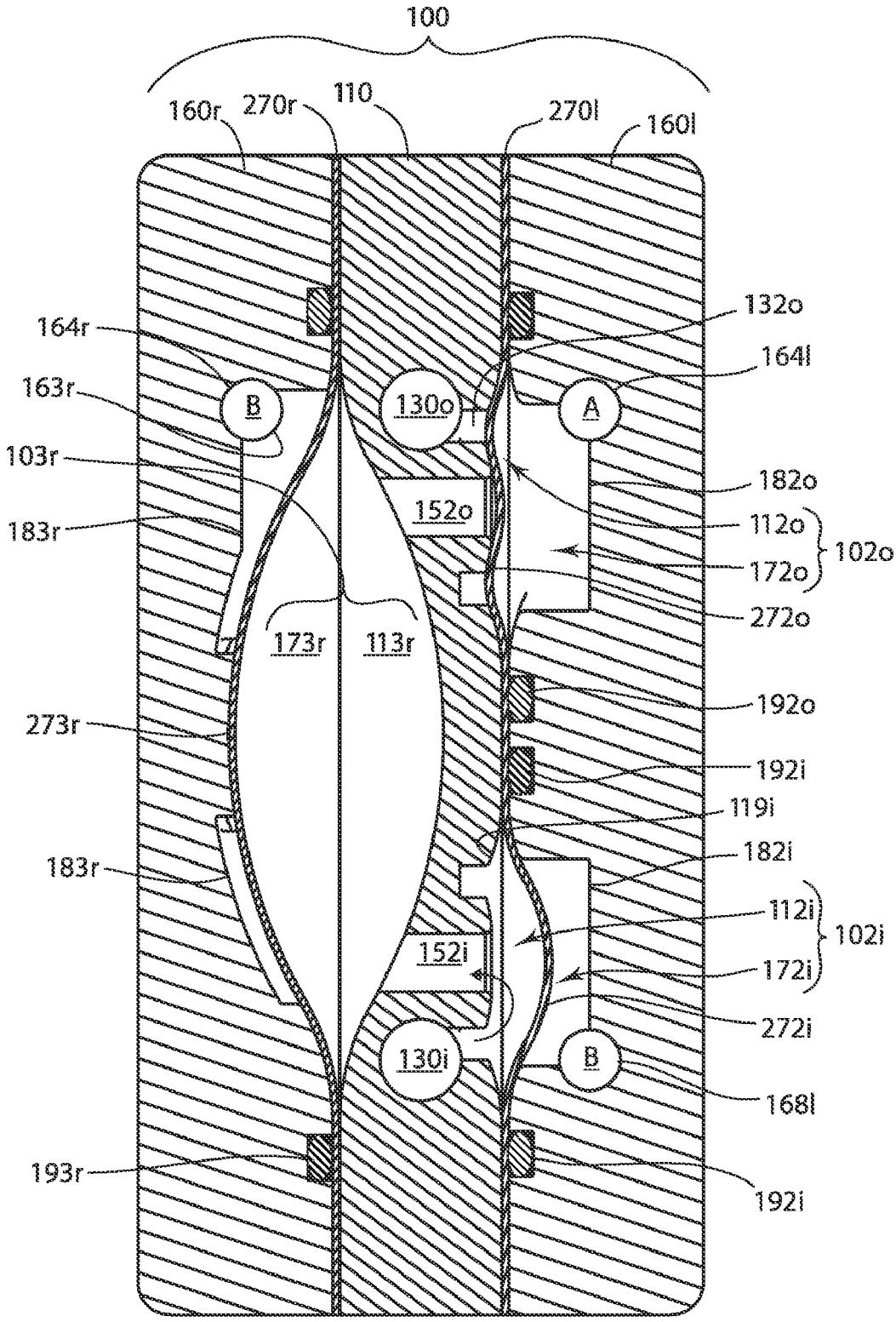
FIG. 4C is a cross-sectional view of the double diaphragm pump taken along cutting line 4C-4C in FIG. 4A.

FIGS. 4B-4C are transverse cross-sectional views taken along the cutting lines shown in FIG. 4A to show the operation of first inlet valve chamber 101*i*, first outlet valve chamber 101*o*, second inlet valve chamber 102*i*, second outlet valve chamber 102*o*, left pump chamber 103*l*, and right pump chamber 103*r* via manifold A and manifold B. FIGS. 4B-4C also show the operation of left integrated diaphragm media 270*l* and right integrated diaphragm media 270*r*.

FIG. 4B shows first inlet valve chamber 101*i*, first outlet valve chamber 101*o* and left pump chamber 103*l*. In FIG. 4B, the left integrated diaphragm media 270*l* and right integrated diaphragm media 270*r* are shown at the end of their flexing strokes where pressure is being applied in manifold A while a vacuum is applied in manifold B. Pressure in manifold A prevents fluid communication via chamber channel 151*i* between first inlet valve chamber 101*i* and left pump chamber 103*l* by flexing first inlet valve region 271*i* of right integrated diaphragm media 270*r*. Simultaneously, pressure in manifold A drives against left pump chamber region 273*l* of left integrated diaphragm media 270*l* and forces the process fluid through chamber channel 151*o*, as identified in FIG. 3B, into first outlet valve chamber 101*o*, and then out of pump 100 via outlet line 130*o*. As shown in FIG. 4C, the pressure in manifold A also prevents fluid communication via chamber channel 152*o* between second outlet valve chamber 102*o* and right pump chamber 103*r*.

FIG. 40 shows second inlet valve chamber 102*i*, second outlet valve chamber 102*o* and right pump chamber 103*r*. As indicated above, FIGS. 4B-4C show the simultaneous application of pressure in manifold A and a vacuum in manifold B in different cross-sectional views. The vacuum in manifold B pulls right pump chamber region 273*r* of right integrated diaphragm media 270*r* against the surfaces 184*r* of actuation cavity 173*r* via recess 183*r*. The vacuum in manifold B also pulls second inlet valve region 272*i* of left integrated diaphragm media 270*l* into second inlet valve chamber 102*i*. By pulling second inlet valve region 272*i*, fluid communication is provided for the process fluid from inlet line 130*i*, into second inlet valve chamber 102*i*, through chamber channel 152*i* and then into right pump chamber 103*r*. The vacuum in manifold B also pulls first outlet valve region 271*o* into first outlet valve chamber 101*o* so that the process fluid passes more easily from chamber channel 151*o*, into first outlet valve chamber 101*o*, and then into outlet line 130*o*.

Figure 4E:
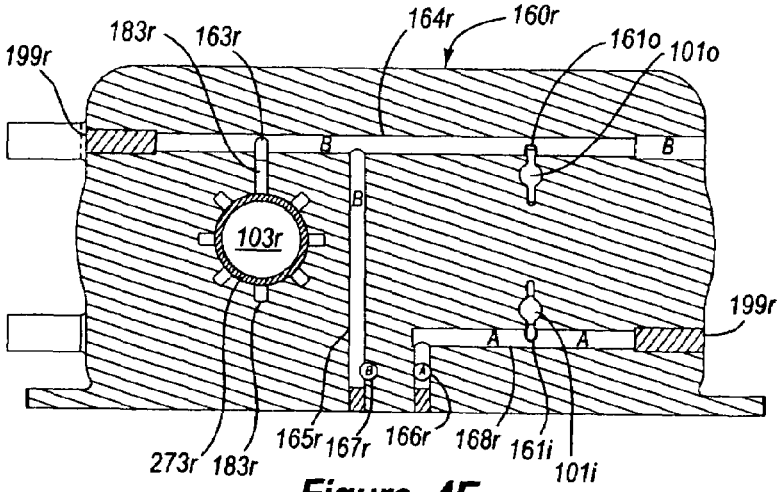
FIG. 4E is a cross-sectional view of the double diaphragm pump taken along cutting line 4E-4E in FIG. 4D.
Figure 4D:
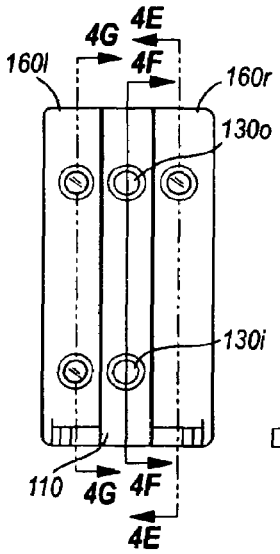
FIG. 4D is a view of an end of the double diaphragm pump which shows cutting lines 4E-4E, 4F-4F, and 4G-4G.
Figure 4F:
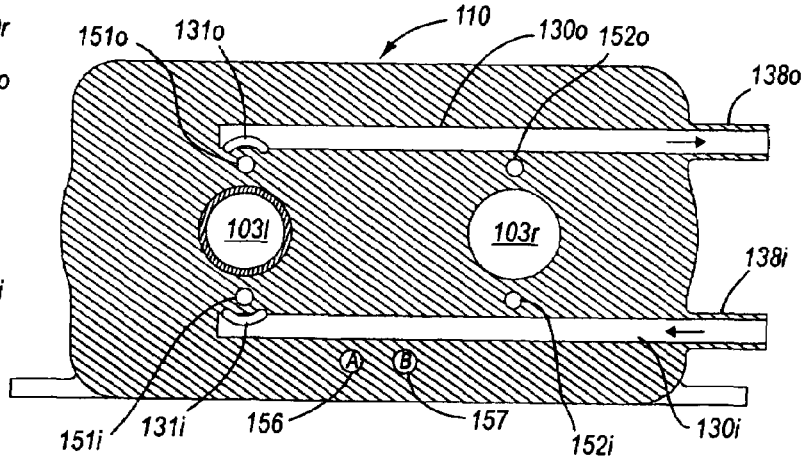
FIG. 4F is a cross-sectional view of the double diaphragm pump taken along cutting line 4F-4F in FIG. 4D.
Figure 4G:
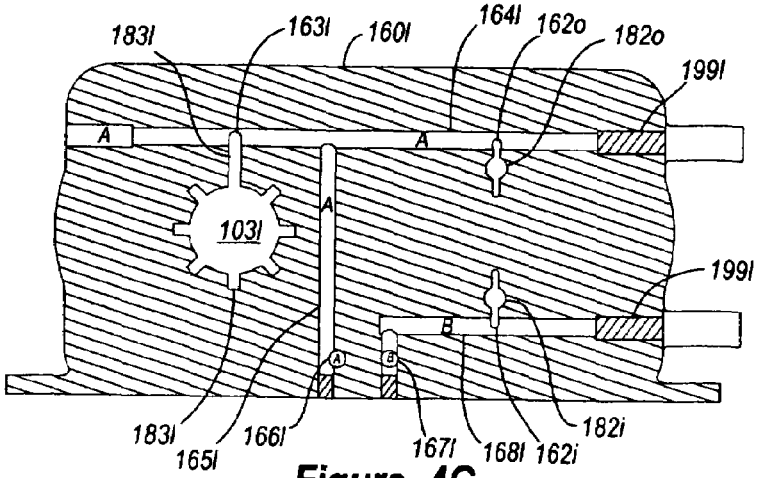
FIG. 4G is a cross-sectional view of the double diaphragm pump taken along cutting line 4G-4G in FIG. 4D.

FIGS. 4E-4G are longitudinal cross-sectional views taken along the cutting lines shown in FIG. 4D which depict manifold A, manifold B and the lines for the process fluid. As shown, pressure or a vacuum is simultaneously applied to the diaphragm regions in left pump chamber 103*l*, first inlet valve chamber 101*i*, and second outlet valve chamber 102*o*. Also simultaneously, manifold A receives the opposite of the pressure or vacuum being applied in manifold B. Manifold B then causes pressure or a vacuum to be applied to the diaphragm regions in right pump chamber 103*r*, first outlet valve chamber 101*o*, and second inlet valve chamber 102*i*. While the components linked to manifold A and manifold B may be simultaneously operated they may also be independently controlled such that they are not operated at opposite pressures.

FIG. 5 provides a schematic view which shows the connections between the valves and the pump chambers. FIG. 5 also shows the first and second motive fluids respectively as a pressure source 20 and a vacuum source or vent 30. FIG. 5 also shows that the motive fluids are in fluid communication with pump 100 via valve 10. The vacuum source or vent is at a pressure that is less than the process liquid source pressure to allow intake of the process fluid into the pumping chambers. The motive fluid pressures can be selectively controlled by pressure regulators (not shown in FIG. 5) or other devices to the desired pressures needed to pump the process fluid. Valve 10 is controlled by an electric or pneumatic controller 12. By restricting the process fluid discharge and cycling the control valve 10 to cyclically apply pressure and vacuum to manifolds A and B prior to the integrated diaphragm media reaching the end of stroke or pump chamber surface 114*r* and 114*l*, the process liquid pressure and flow is substantially maintained. A process liquid source 38 is also shown coupled to inlet line extension 138*i*. An example of a first motive fluid is compressed air at a first pressure such as 30 psig (pounds per square inch gage) pressure and an example of a second motive fluid is air at a second pressure such as −5 psig vacuum pressure.

FIG. 5 shows the flow paths of the motive fluid. Manifold A is shown having fluid communication with the first inlet valve or more particularly, first inlet valve chamber 101*i*; the second outlet valve or more particularly, second outlet valve chamber 102*o* and also actuation cavity 173*l* of left pump chamber 103*l*. Manifold B is shown in fluid communication with the first outlet valve or more particularly, first outlet valve chamber 101*o*; the second inlet valve or more particularly, second inlet valve chamber 102*i* and also to actuation cavity 173*r* of right pump chamber 103*r*.

Fluid communication is also in FIG. 5 with regard to the process fluid. Left pump chamber cavity 113*l* is in fluid communication with first inlet valve chamber 101*i* and first outlet valve chamber 101*o*. Right chamber cavity 113*r* is in fluid communication with second inlet valve chamber 102*i* and second outlet valve chamber 102*o*.

A flow restrictor 380 is shown outside of pump 100 in FIG. 5 coupled to outlet line extension 138*o*. The embodiment of pump 100' shown in FIG. 7 differs from pump 100 in that the flow restrictor 380 is within pump 100'. The flow restrictor is a passage which has a smaller cross-section area than an upstream cross-sectional area. The flow restrictor prevents the process fluid from discharging from the pump 100 faster than pump chambers can be cycled to be suction filled and pressure discharged creating a substantially continuous flow.

Figure 6:
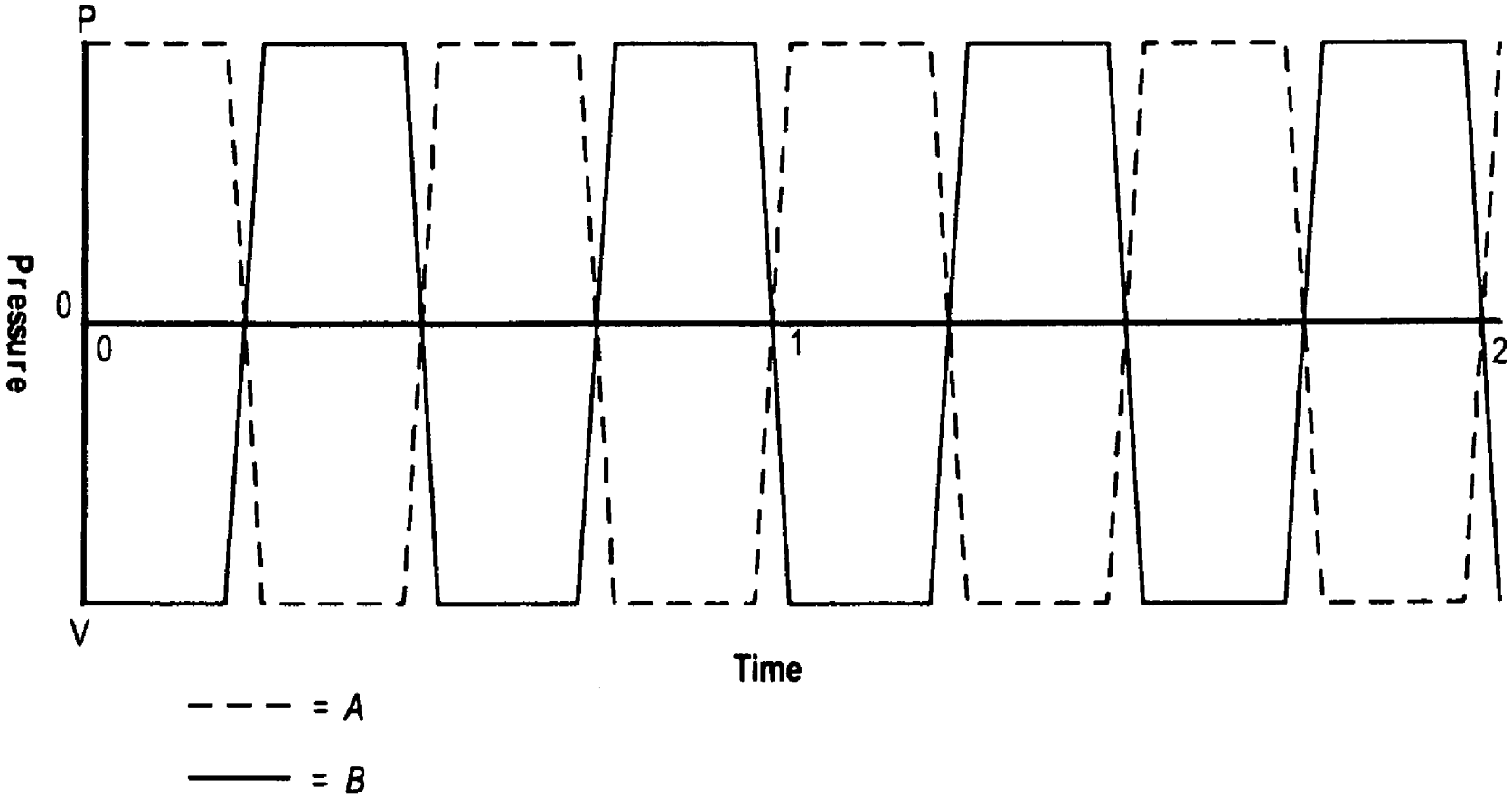
FIG. 6 is a chart of the pressure over time of the motive fluid in the system depicted in FIG. 5.
Figure 7:
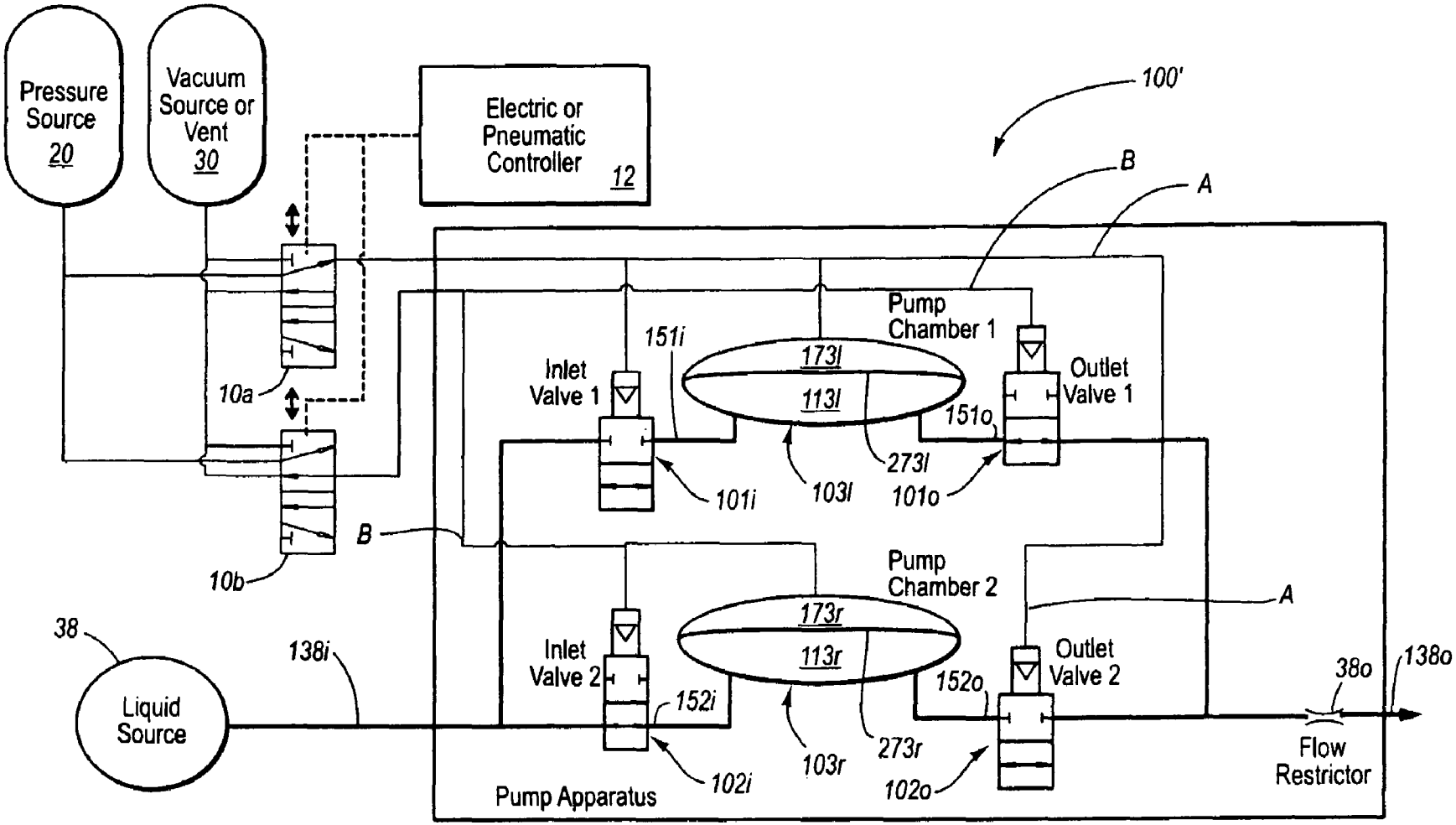
FIG. 7 is a schematic view of a double diaphragm pump as used in a method and system for transferring fluid. The system has two pressure/vacuum valves.
Figure 8:
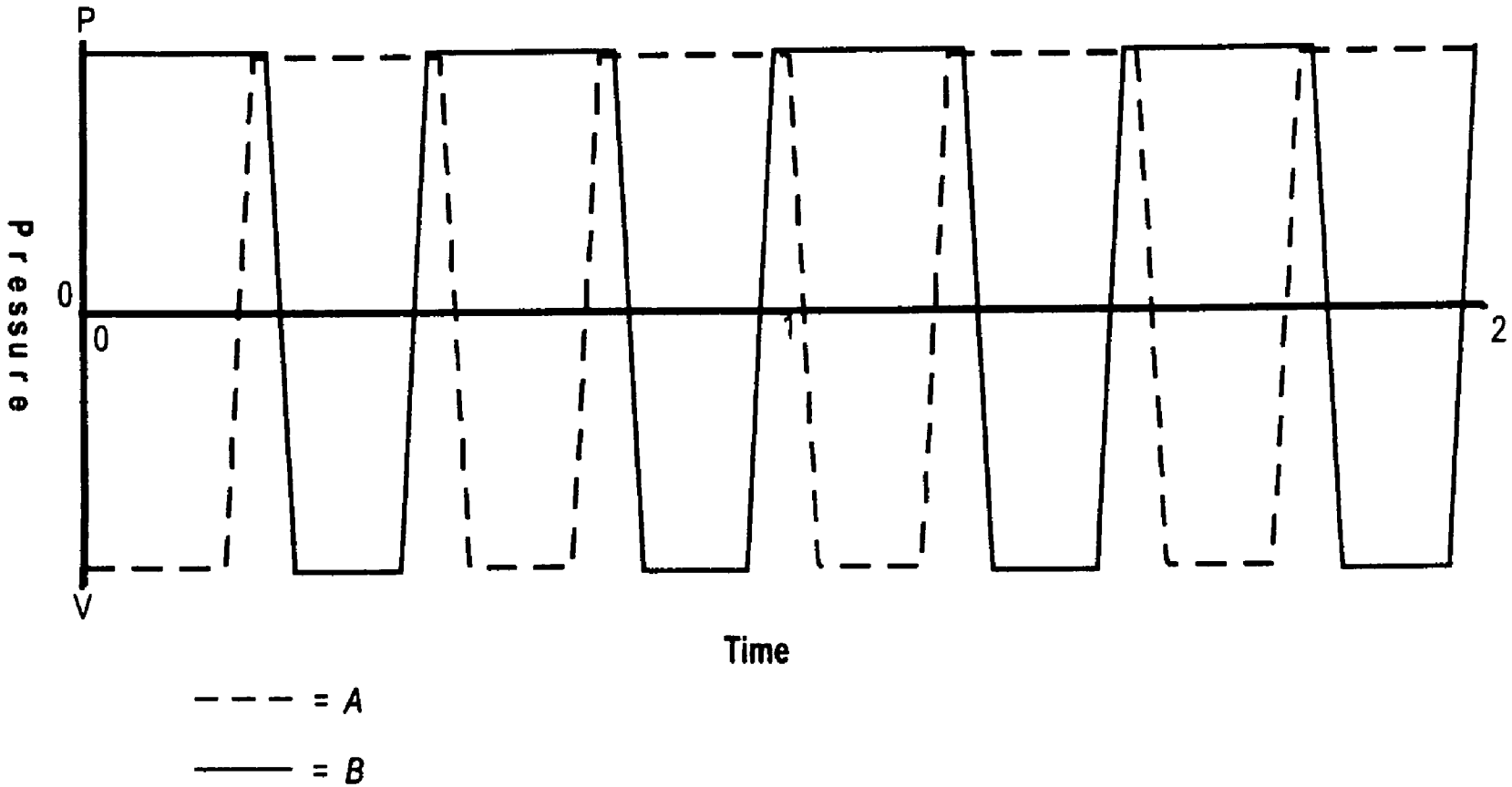
FIG. 8 is a chart of the pressure over time of the motive fluid in the system depicted in FIG. 7.

The embodiment of the system shown in FIG. 7 also differs from the embodiment shown in FIG. 5 as it uses two valves 10*a* and 10*b* which separately control the pressure and suction applied to manifold A and manifold B. FIG. 6 shows the pressures and vacuums experienced by manifold A and manifold B when a single valve is used as shown in FIG. 5. FIG. 8 shows the pressures and vacuums experienced by manifold A and manifold B when two valves are used as shown in FIG. 7. By contrasting the graphs shown in FIG. 6 and FIG. 8, it is apparent that the discharge pressure droop during the cycle shift is reduced. This droop is caused by the time required to switch a single valve from one position to another. This droop is reduced through the use of two valves.

All of the double diaphragm pump components exposed to process fluids can be constructed of non-metallic and/or chemically inert materials enabling the apparatus to be exposed to corrosive process fluids without adversely changing the operation of the double diaphragm pump. For example, the fluid body 110, left motive fluid plate 160*l* and right motive fluid plate 160*r* may be formed from polymers or metals depending on the material compatibility with the process fluid. Diaphragm media may be formed from a polymer or an elastomer. An example of a suitable polymer that has high endurance to cyclic flexing is a fluorpolymer such as polytetrafluoroethylene (PTFE), polyperfluoroalkoxyethylene (PFA), or fluorinated ethylene propylene (FEP).

In the depicted embodiments, the pre-formed regions of right integrated diaphragm media 270*r* namely, first inlet valve region 271*i*, first outlet valve region 271*o* and second pump chamber region 273*r* and the pre-formed regions of left integrated diaphragm media 270*l* namely, second inlet valve region 272*i*, second outlet valve region 272*o* and first pump chamber region 273*l*, which are formed from a film with a uniform thickness. The thickness of the diaphragm media may be selected based on a variety of factors such as the material, the size of the valve or chamber in which the diaphragm moves, etc. Since the diaphragms only isolate the motive fluid from the process fluid when they are not at an end of stroke condition and are intermittently supported by the pump chamber cavities when at end of stroke conditions, the diaphragm media thickness is only required to sufficiently isolate the process fluid from the motive fluid and to have enough stiffness to generally maintain its form when pressurized against features in the pump cavities. When flexing to the same shape, a thin diaphragm has a lower level of mechanical strain when cycled than a thicker diaphragm. The lower cyclic strain of a thin diaphragm increases the life of the diaphragm before mechanical failure of the material. In one embodiment, the diaphragm media has a thickness in a range from about 0.001" to about 0.060". In another embodiment, the diaphragm media has a thickness in a range from about 0.005" to about 0.010".

Figure 9A:
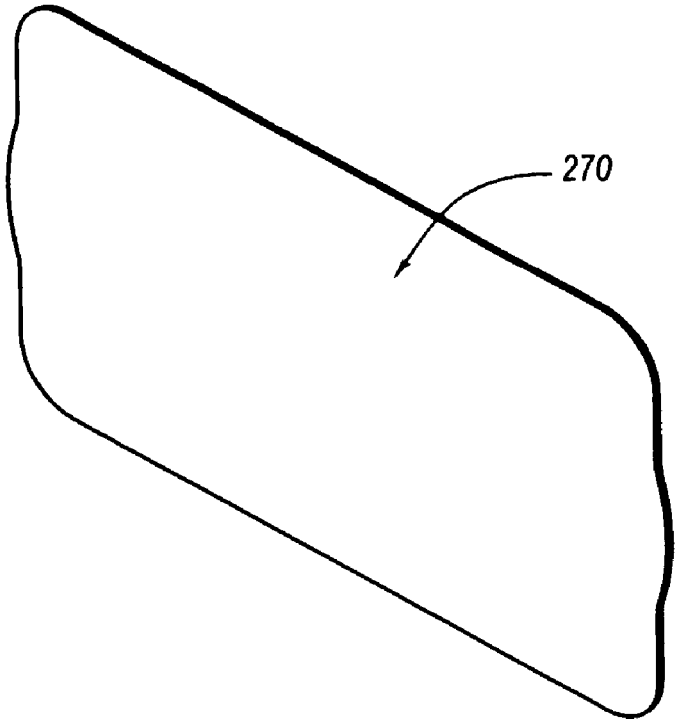
FIG. 9A is a diaphragm media before the regions have been formed.
Figure 9B:
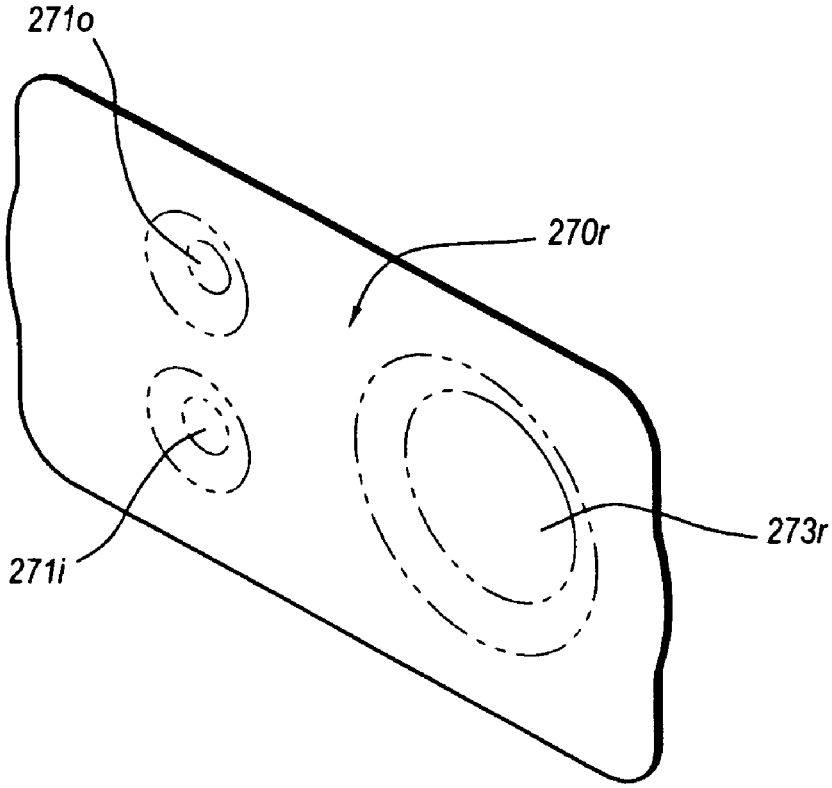
FIG. 9B is a diaphragm media after the regions have been formed.

FIG. 9A depicts a diaphragm media 270 before the regions have been pre-formed or pre-stretched. The diaphragm media has been cut from a sheet of film. Diaphragm media has a uniform thickness and is then shaped to yield pre-formed or pre-stretched regions. FIG. 9B depicts right integrated diaphragm media 270*r* as it appears after diaphragm media 270 has been pre-formed or pre-stretched in forming fixture 300 as shown in FIGS. 10A-10D.

While FIGS. 10A-10D depict the use of diaphragm media 270 to form right integrated diaphragm media 270*r*, forming fixture 300 can also be used to form left integrated diaphragm media 270*l*. FIGS. 10A-10D depict the use of pressure or vacuum to shape the regions of the diaphragm media. Heat could also be used separately or in addition to the vacuum or pressure used to form the regions in the diaphragm media.

Figure 10A:
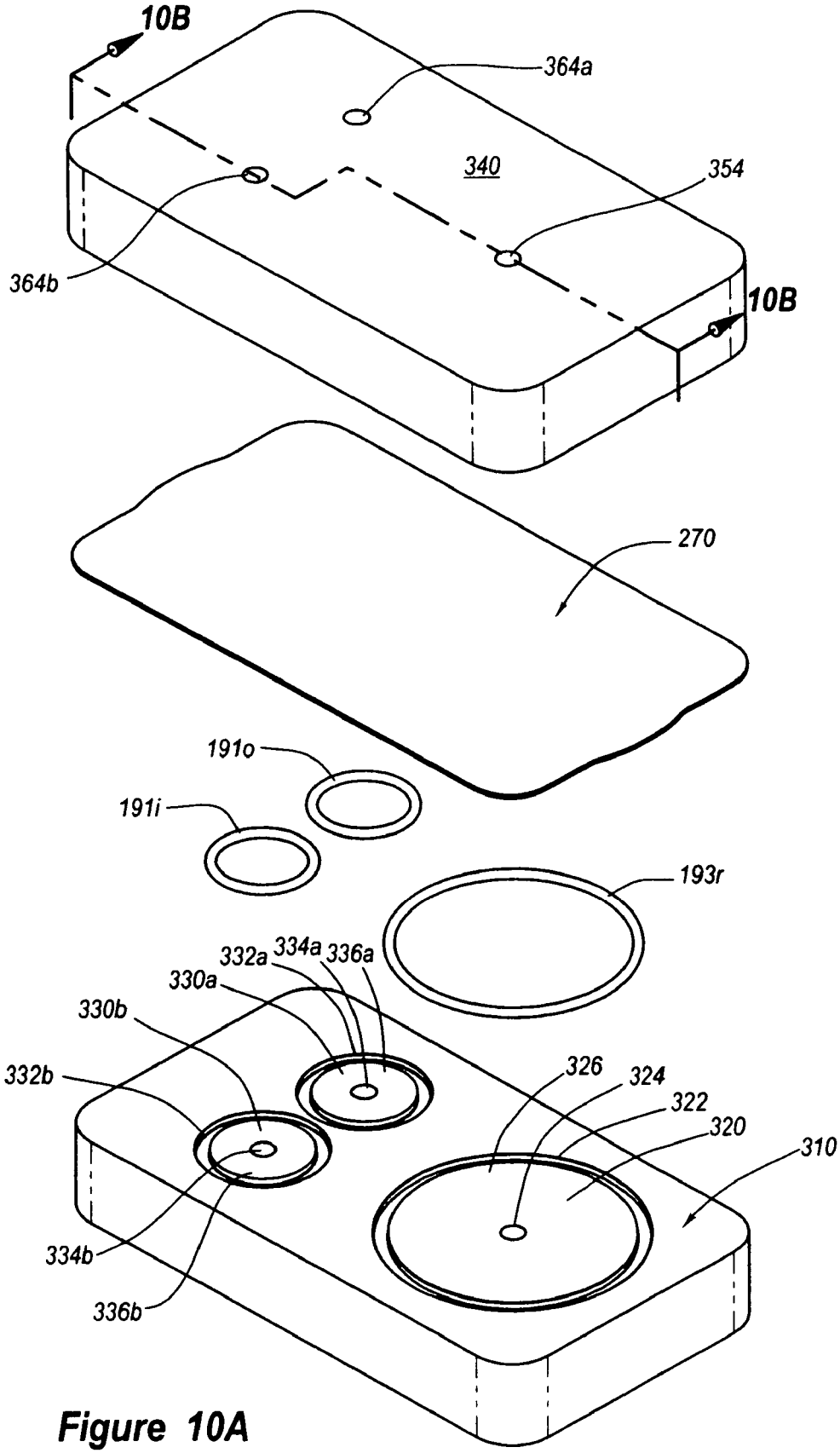
FIG. 10A is an exploded perspective view of a forming fixture used to form the regions in the diaphragm media.

FIG. 10A depicts first plate 310 and second plate 340 of forming fixture 300 in an exploded view. Because forming fixture 300 is shown being used to produce a right integrated diaphragm media 270*r* from diaphragm media 270, the o-rings depicted include o-rings 191*i*, 191*o* and 193*r*.

First plate 310 is shown in FIG. 10A with a chamber region face 320 and valve region faces 330*a* and 330*b*. Chamber region face 320 is circumscribed by o-ring groove 322. Valve region faces 330*a* and 330*b* are respectively circumscribed by o-ring grooves 332*a-b*. The other surface area of the top of first plate 310 is referred to herein as the face of first plate 310. Face 320 has a portal 324 and faces 330*a-b* have respective portals 334*a-b*.

Figure 10B:
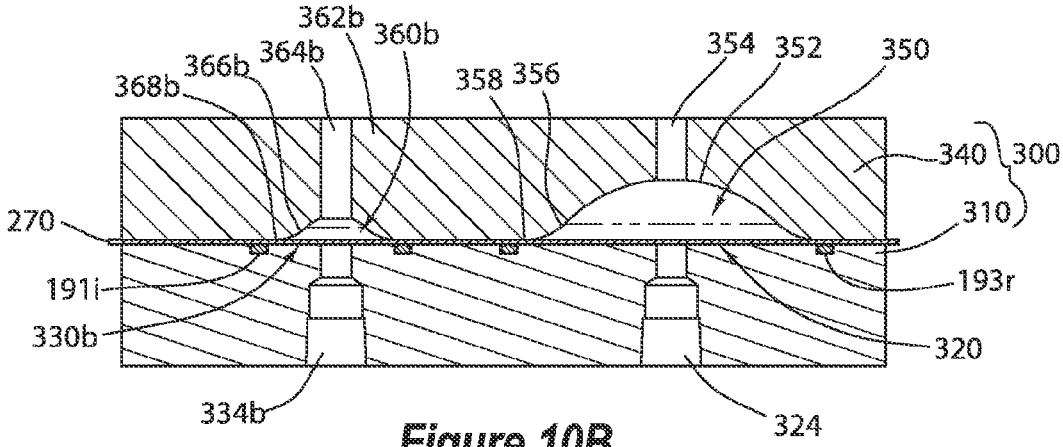
FIG. 10B is a cross-sectional view of a forming fixture after a diaphragm media has been loaded to be pre-stretched used to form the regions in the diaphragm media.

FIG. 10B shows fixture 300 with diaphragm media 270 between first plate 310 and second plate 340. Fixture 300 includes chamber region recess 350 and valve region recess 360*b*. The fixture 300 can be clamped together with mechanical fasteners or other assembly mechanisms to hold the diaphragm media 270 in position and to withstand the pressure required to pre-form or pre-stretch the diaphragm media 270. Pressure has not yet been delivered via portals 324 and 334*a-b* so diaphragm media 270 is shown resting and sealed between faces 320 and 330*a-b* and the remainder of the face of first plate 310.

Second plate 340 has chamber region recess 350 with a recess surface 352 and a portal 354. Second plate 340 also has valve regions with recesses 360*b* with respective recess surfaces 362*b* and portals 364*b*. Each recess surface is defined by a lip as identified at 356 and 366*b*. In this embodiment, each lip is essentially the portion of the face of second plate 340 around the respective recesses. Diaphragm media 270 is circumferentially held between perimeter 326 and lip 356, perimeter 336*a* and lip 366*a*, and perimeter 336*b* and lip 366*b*, so that the circumscribed regions of diaphragm media 270 can be directed toward recess surfaces 352 and 362*a-b*. Each recess surface has a rim portion which is the transition to the lip. The rim portions are identified at 358 and 368*b*.

Figure 10C:
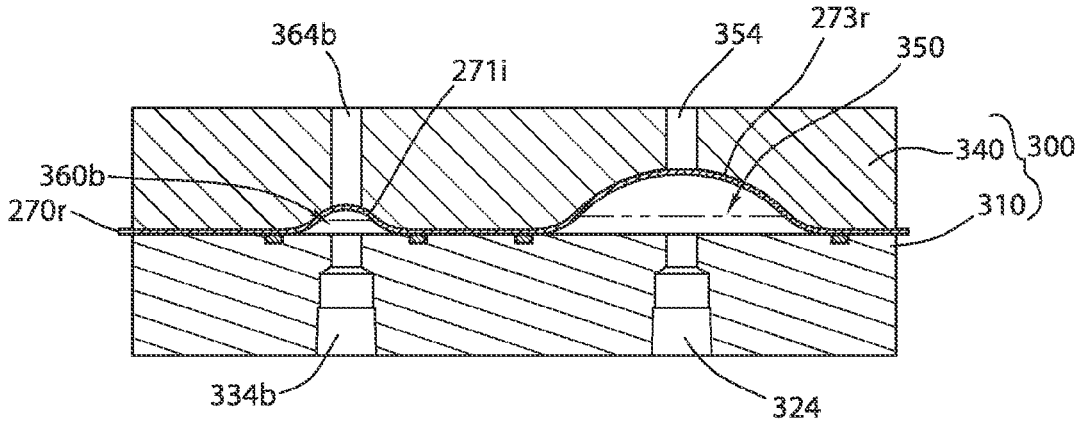
FIG. 10C is a cross-sectional view of the forming fixture forming the regions in the diaphragm media.
Figure 10D:
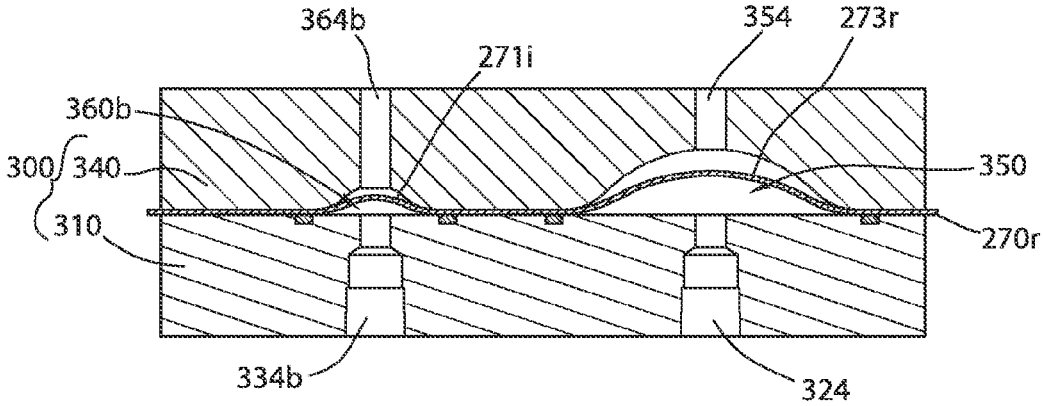
FIG. 10D is a cross-sectional view of the forming fixture after the regions in the diaphragm media have been formed.

FIG. 10C shows pressure or a vacuum being used to form regions in right integrated diaphragm media 270*r* namely, first inlet valve region 271*l* and second pump chamber region 273*r*. FIGS. 10B-10D do not depict the formation of first outlet valve region 271*o* due to the orientation of cut line 10B-10B but it is formed in the same way as first inlet valve region 271*i*. Diaphragm media 270 becomes right integrated diaphragm media 270*r* as region 273*r* is driven against recess surface 352, region 271*i* is driven against recess surface 362*b*, and region 271*o* is driven against recess surface 362*a*. Note that the rim portions 358 and 368*b* may be configured to yield regions as shown in FIG. 9B with inner perimeters and outer perimeters.

Regions 271*i*, 271*o* and 273*r* are formed in fixture 100 using a differential pressure that exceeds the elastic limit of the diaphragm material. Pressure may be delivered via portals 324 and 334*a-b*, a vacuum may be applied via portals 354 and 364*a-b* and a combination of both pressure and a vacuum may be used to stretch the regions of the diaphragm media. The differential pressure stretches the regions of diaphragm media 270 so that when the differential pressure is removed, the stretched regions have a particular cord length. The cord length is sufficient to enable the diaphragm regions to flex and pump the fluid in the pump chamber and to flex and controllably seal the fluid flow through the pump valves at the same pressures. By pre-forming the regions of the diaphragm media, additional pressure is not required to seat the valve regions as compared with the pressure required for movement of the region of the diaphragm in the pump chamber. Additionally by controlling the cord length of the diaphragm media 270, the mechanical cycle life of the diaphragm is increased by minimizing material strain when flexing from one end of stroke condition to the other end of stroke condition and stretching of the material is not required for the diaphragm to reach the end of stroke condition.

FIG. 10D depicts right integrated diaphragm media 270*r* after the formation of first inlet valve region 271*i* and second pump chamber region 273*r*. As mentioned above, first outlet valve region 271 is not shown in FIG. 10D. Pre-stretching the valve regions of the integrated diaphragm media and the chamber regions enables the valve regions to be seated and the chamber regions to move fluid into and out of the chambers based only on sufficient pressure (positive or negative) for movement of the regions. Stated otherwise, after these regions have been formed by stretching the diaphragm media, the regions move in response to fluid pressure with essentially no stretching as each valve or chamber cycles via movement of the diaphragm regions. In one embodiment, the diaphragm regions are sufficiently pre-stretched so that the cord length of the valve regions and the chamber regions remains constant while cycling. In another embodiment, there is essentially no stretching which means that the cord length changes less than 5% during each pump cycle. Since pressure is applied only for movement either exclusively or for movement and at most a nominal amount for stretching the pre-formed regions, the amount of pressure is low and the lifespan of the diaphragm media is extended due to the gentler cycling. Since material strain is reduced using thin film materials in the construction of the flexing diaphragm media 270 and in-plane stretching of the diaphragm media is controlled by the support of the pump cavities at end of stroke conditions, long mechanical life of diaphragms can be achieved.

In alternative embodiments, the double diaphragm pump can be constructed with the inlet and outlet valve chambers and pump chambers located on the same side of the process fluid body. The pump chambers can also be located on the same side of process fluid body while the inlet and outlet valve chambers can be located on the opposite side of the process fluid body. The process fluid body can be constructed with more than two pump cavities, more than two inlet valves, and more than two outlet valves to cooperatively work in pumping a single fluid. Also, multiple double diaphragm pumps can be constructed on a single process fluid body. The integrated diaphragm media can also have more valve regions and pump chamber regions than those shown in the depicted embodiments.

Without further elaboration, it is believed that one skilled in the art can use the preceding description to utilize the invention to its fullest extent. The examples and embodiments disclosed herein are to be construed as merely illustrative and not a limitation of the scope of the present invention in any way. It will be apparent to those having skill in the art that changes may be made to the details of the above-described embodiments without departing from the underlying principles of the invention. In other words, various modifications and improvements of the embodiments specifically disclosed in the description above are within the scope of the appended claims. Note that elements recited in means-plus-function format are intended to be construed in accordance with 35 U.S.C. §112 ¶6. The scope of the invention is therefore defined by the following claims.

What is claimed is:

1. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve; and a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

wherein the diaphragm of the first inlet pressure-activated diaphragm valve and the diaphragm of the first pump chamber are simultaneously moved by a first motive fluid;

wherein the diaphragm of the second inlet pressure-activated diaphragm valve and the diaphragm of the second pump chamber are simultaneously moved by a second motive fluid;

wherein the first pump chamber and the first inlet pressure-activated diaphragm valve are in fluid communication with the second outlet pressure-activated diaphragm valve; and wherein the second pump chamber and the second inlet pressure-activated diaphragm valve are in fluid communication with the first outlet pressure-activated diaphragm valve.

2. A pump as defined in claim 1, wherein the diaphragm of the first inlet pressure-activated diaphragm valve, the diaphragm of the first outlet pressure-activated diaphragm valve and the diaphragm of the second pump chamber comprise an integrated diaphragm media.

3. A pump as defined in claim 1, wherein the diaphragm of the second inlet pressure-activated diaphragm valve, the diaphragm of the second outlet pressure-activated diaphragm valve and the diaphragm of the first pump chamber comprise an integrated diaphragm media.

4. A pump as defined in claim 1, wherein the first motive fluid is compressed air with a pressure greater than the process fluid pressure entering the pump and the second motive fluid is a vacuum source to discharge air with a pressure less than the process fluid pressure entering the pump.

5. A pump as defined in claim 1, further comprising a first motive fluid plate, a second motive fluid plate, and a process fluid body between the first motive fluid plate and the second motive fluid plate.

6. A pump as defined in claim 5, wherein the input line extends within the process fluid body and is in fluid communication with the first and second inlet pressure-activated diaphragm valves and the output line extends within the process fluid body and is in fluid communication with the first and second outlet pressure-activated diaphragm valves.

7. A pump as defined in claim 5, wherein the first inlet pressure-activated diaphragm valve and the first outlet pressure-activated diaphragm valve are both defined by the second motive fluid plate and the process fluid body; and wherein the second inlet pressure-activated diaphragm valve and the second outlet pressure-activated diaphragm valve are both defined by the first motive fluid plate and the process fluid body.

8. A pump as defined in claim 5, wherein each pressure-activated diaphragm valve comprises its diaphragm which moves within a valve chamber in response to fluid pressure, and wherein each valve chamber comprises a valve seat defined by the process fluid body and an actuation cavity defined by one of the motive fluid plates.

9. A pump as defined in claim 5, wherein the first pump chamber comprises an actuation cavity defined by the first motive fluid plate and a first pump chamber cavity defined by the process fluid body; and wherein the second pump chamber comprises an actuation cavity defined by the second motive fluid plate and a second pump chamber cavity defined by the process fluid body.

10. A pump as defined in claim 9, wherein the first inlet pressure-activated diaphragm valve comprises a first inlet valve chamber and the diaphragm of the first inlet pressure-activated diaphragm valve moves within the first inlet valve chamber in response to fluid pressure;

wherein the first inlet valve chamber comprises an actuation cavity defined by the second motive fluid plate and a first inlet valve seat defined by the process fluid body;

wherein the first outlet pressure-activated diaphragm valve comprises a first outlet valve chamber and the diaphragm of the first outlet pressure-activated diaphragm valve moves within the first outlet valve chamber in response to fluid pressure;

wherein the first outlet valve chamber comprises an actuation cavity defined by the second motive fluid plate and a first outlet valve seat defined by the process fluid body;

wherein the second inlet pressure-activated diaphragm valve comprises a second inlet valve chamber and the diaphragm of the second inlet pressure-activated diaphragm valve moves within the second inlet valve chamber in response to fluid pressure;

wherein the second inlet valve chamber comprises an actuation cavity defined by the first motive fluid plate and a second inlet valve seat defined by the process fluid body;

wherein the second outlet pressure-activated diaphragm valve comprises a second outlet valve chamber and the diaphragm of the second outlet pressure-activated diaphragm valve moves within the second outlet valve chamber in response to fluid pressure; and wherein the second outlet valve chamber comprises an actuation cavity defined by the first motive fluid plate and a second outlet valve seat defined by the process fluid body.

11. A pump as defined in claim 1, wherein a first inlet chamber channel extends from the first pump chamber cavity to the first inlet valve seat to provide fluid communication between the first pump chamber and the first inlet pressure-activated diaphragm valve for movement of a process fluid into the first pump chamber from the input line;

wherein a first outlet chamber channel extends from the first pump chamber cavity to the first outlet valve seat to provide fluid communication between the first pump chamber and the first outlet pressure-activated diaphragm valve for movement of a process fluid from the first pump chamber to the output line;

wherein a second inlet chamber channel extends from the second pump chamber cavity to the second inlet valve seat to provide fluid communication between the second pump chamber and the second inlet pressure-activated diaphragm valve for movement of a process fluid into the second pump chamber from the input line; and wherein a second outlet chamber channel extends from the second pump chamber cavity to the second outlet valve seat to provide fluid communication between the second pump chamber and the second outlet pressure-activated diaphragm valve for movement of a process fluid from the second pump chamber to the output line.

12. A pump as defined in claim 1, wherein a flow restrictor is positioned to restrict the flow of the process fluid out of the outlet line.

13. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

a first motive fluid plate;

a second motive fluid plate; and a process fluid body between the first motive fluid plate and the second motive fluid plate;

wherein the first inlet pressure-activated diaphragm valve and the first outlet pressure-activated diaphragm valve are both defined by the second motive fluid plate and the process fluid body; and wherein the second inlet pressure-activated diaphragm valve and the second outlet pressure-activated diaphragm valve are both defined by the first motive fluid plate and the process fluid body.

14. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

a first motive fluid plate;

a second motive fluid plate; and a process fluid body between the first motive fluid plate and the second motive fluid plate;

wherein the first pump chamber comprises an actuation cavity defined by the first motive fluid plate and a first pump chamber cavity defined by the process fluid body; and wherein the second pump chamber comprises an actuation cavity defined by the second motive fluid plate and a second pump chamber cavity defined by the process fluid body.

15. A pump for moving a process fluid, the pump comprising:

a process fluid body between a first motive fluid plate and a second motive fluid plate, a first inlet pressure-activated diaphragm valve, a first outlet pressure-activated diaphragm valve, a second inlet pressure-activated diaphragm valve and a second outlet pressure-activated diaphragm valve, wherein the first inlet pressure-activated diaphragm valve and the first outlet pressure-activated diaphragm valve are each defined by one of the motive fluid plates and the process fluid body while the second inlet pressure-activated diaphragm valve and the second outlet pressure-activated diaphragm valve are each defined by the other motive fluid plate and the process fluid body;

a first pump chamber and a second pump chamber, wherein the first pump chamber is defined by one of the motive fluid plates and the process fluid body define and second pump chamber is defined by the other motive fluid plate and the process fluid body;

wherein the first pump chamber achieves fluid communication with an input line via the first inlet pressure-activated diaphragm valve and wherein the first pump chamber achieves fluid communication with an outlet line via the first outlet pressure-activated diaphragm valve;

wherein the second pump chamber achieves fluid communication with the input line via the second inlet pressure-activated diaphragm valve and wherein the second pump chamber achieves fluid communication with the outlet line via the second outlet pressure-activated diaphragm valve;

wherein a diaphragm is positioned in each pump chamber and each valve;

wherein the diaphragm in the first inlet valve and the diaphragm in the first pump chamber are simultaneously moved by a first motive fluid source; and wherein the diaphragm in the second inlet valve and the diaphragm in the second pump chamber are simultaneously moved by a second motive fluid source.

16. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

a first motive fluid plate;

a second motive fluid plate; and a process fluid body between the first motive fluid plate and the second motive fluid plate;

wherein the diaphragm of the first inlet pressure-activated diaphragm valve and the diaphragm of the first pump chamber are simultaneously moved by a first motive fluid;

wherein the diaphragm of the second inlet pressure-activated diaphragm valve and the diaphragm of the second pump chamber are simultaneously moved by a second motive fluid;

wherein the first inlet pressure-activated diaphragm valve and the first outlet pressure-activated diaphragm valve are both defined by the second motive fluid plate and the process fluid body; and wherein the second inlet pressure-activated diaphragm valve and the second outlet pressure-activated diaphragm valve are both defined by the first motive fluid plate and the process fluid body.

17. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

a first motive fluid plate;

a second motive fluid plate; and a process fluid body between the first motive fluid plate and the second motive fluid plate;

wherein the diaphragm of the first inlet pressure-activated diaphragm valve and the diaphragm of the first pump chamber are simultaneously moved by a first motive fluid;

wherein the diaphragm of the second inlet pressure-activated diaphragm valve and the diaphragm of the second pump chamber are simultaneously moved by a second motive fluid;

wherein the first pump chamber comprises an actuation cavity defined by the first motive fluid plate and a first pump chamber cavity defined by the process fluid body; and wherein the second pump chamber comprises an actuation cavity defined by the second motive fluid plate and a second pump chamber cavity defined by the process fluid body.

* * * * *

US007717682C1

(12) EX PARTE REEXAMINATION CERTIFICATE (10762nd)

United States Patent
Orr

(10) Number: US 7,717,682 C1
(45) Certificate Issued: Nov. 12, 2015

(54) DOUBLE DIAPHRAGM PUMP AND RELATED METHODS

(75) Inventor: Troy J. Orr, Draper, UT (US)

(73) Assignee: FRESENIUS MEDICAL CARE HOLDINGS, INC., Waltham, MA (US)

Reexamination Request:
No. 90/020,069, May 29, 2014

Reexamination Certificate for:

| | |
|---|---|
| Patent No.: | **7,717,682** |
| Issued: | **May 18, 2010** |
| Appl. No.: | **11/484,061** |
| Filed: | **Jul. 11, 2006** |

Related U.S. Application Data

(60) Provisional application No. 60/699,262, filed on Jul. 13, 2005.

(51) Int. Cl.

| | |
|---|---|
| ***F04B 45/053*** | (2006.01) |
| ***F04B 9/109*** | (2006.01) |
| ***F04B 23/04*** | (2006.01) |
| ***F04B 43/02*** | (2006.01) |

(52) U.S. Cl.
CPC ..... *F04B 9/109* (2013.01); *F04B 43/02* (2013.01)

(58) Field of Classification Search
None
See application file for complete search history.

(56) References Cited

To view the complete listing of prior art documents cited during the proceeding for Reexamination Control Number 90/020,069, please refer to the USPTO's public Patent Application Information Retrieval (PAIR) system under the Display References tab.

*Primary Examiner* — Glenn K Dawson

(57) ABSTRACT

A pump for transferring a process fluid has a first pump chamber and a second pump chamber. A motive fluid actuates the pump chambers and control flow valves. The direction of process fluid flow is controlled by varying the amounts of pressure or the use of a vacuum. The control flow valves utilize diaphragms for actuation.

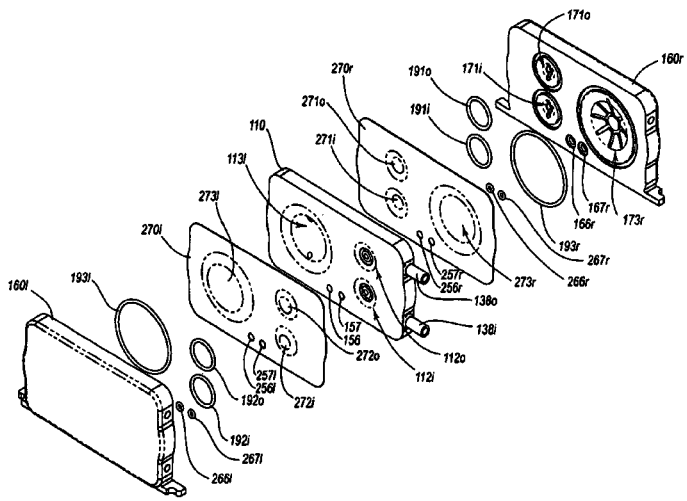

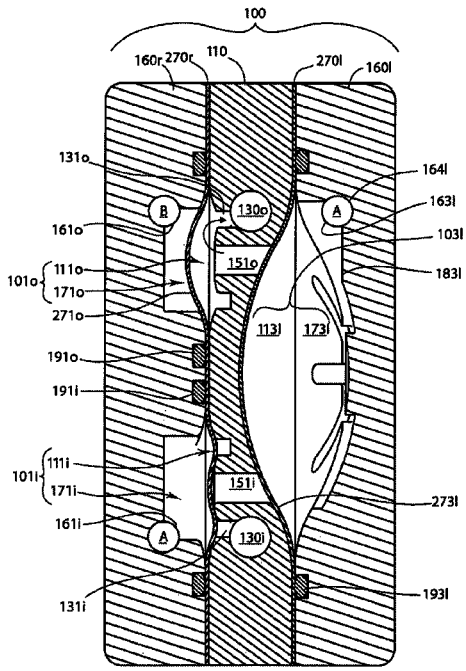

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5 and 13-17 are determined to be patentable as amended.

Claims 2-4 and 6-12, dependent on an amended claim, are determined to be patentable.

New claims 18-72 are added and determined to be patentable.

1. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve; [and]

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

*a first manifold; and*

*a second manifold;* wherein the diaphragm of the first inlet pressure-activated diaphragm valve and the diaphragm of the first pump chamber are simultaneously moved by a first motive fluid *via the first manifold*;

wherein the diaphragm of the second inlet pressure-activated diaphragm valve and the diaphragm of the second pump chamber are simultaneously moved by a second motive fluid *via the second manifold*;

wherein the first pump chamber and the first inlet pressure-activated diaphragm valve are in fluid communication with the second outlet pressure-activated diaphragm valve *via the first manifold, wherein the first manifold communicates the first motive fluid between the first pump chamber, the first inlet pressure-activated diaphragm valve and the second outlet pressure-activated diaphragm valve*; *and* wherein the second pump chamber and the second inlet pressure-activated diaphragm valve are in fluid communication with the first outlet pressure-activated diaphragm valve *via the second manifold, wherein the second manifold communicates the second motive fluid between the second pump chamber, the second inlet pressure-activated diaphragm valve and the first outlet pressure-activated diaphragm valve*.

5. [A pump as defined in claim 1, further comprising] *A pump for moving a process fluid, the pump comprising:*

*a first inlet pressure-activated diaphragm valve, a first outlet pressure-activated diaphragm valve, a second inlet pressure-activated diaphragm valve, and a second outlet pressure activated diaphragm valve;*

*a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve; and*

*a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;*

*wherein the diaphragm of the first inlet pressure-activated diaphragm valve and the diaphragm of the first pump chamber are simultaneously moved by a first motive fluid;*

*wherein the diaphragm of the second inlet pressure-activated diaphragm valve and the diaphragm of the second pump chamber are simultaneously moved by a second motive fluid;*

*wherein the first pump chamber and the first inlet pressure-activated diaphragm valve are in fluid communication with the second outlet pressure-activated diaphragm valve;*

*wherein the second pump chamber and the second inlet pressure-activated diaphragm valve are in fluid communication with the first outlet pressure-activated diaphragm valve; and* a first motive fluid plate, a second motive fluid plate, and a process fluid body between the first motive fluid plate and the second motive fluid plate.

13. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

a first motive fluid plate;

a second motive fluid plate; [and]

a process fluid body between the first motive fluid plate and the second motive fluid plate;

*a first manifold formed in the pump; and*

*a second manifold formed in the pump;* wherein the first inlet pressure-activated diaphragm valve and the first outlet pressure-activated diaphragm valve are both defined by the second motive fluid plate and the process fluid body; [and]

wherein the second inlet pressure-activated diaphragm valve and the second outlet pressure-activated diaphragm valve are both defined by the first motive fluid plate and the process fluid body;

*wherein the first pump chamber and the first inlet pressure-activated diaphragm valve are in fluid communication with the second outlet pressure-activated diaphragm valve via the first manifold, wherein the first manifold communicates a first motive fluid between the first pump chamber, the first inlet pressure-activated diaphragm valve and the second outlet pressure-activated diaphragm valve; and*

*wherein the second pump chamber and the second inlet pressure-activated diaphragm valve are in fluid communication with the first outlet pressure-activated diaphragm valve via the second manifold, wherein the second manifold communicates a second motive fluid between the second pump chamber, the second inlet pressure-activated diaphragm valve and the first outlet pressure-activated diaphragm valve.*

14. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

a first motive fluid plate;

a second motive fluid plate; [and]

a process fluid body between the first motive fluid plate and the second motive fluid plate;

*a first manifold formed in the pump; and*

*a second manifold formed in the pump;* wherein the first pump chamber comprises an actuation cavity defined by the first motive fluid plate and a first pump chamber cavity defined by the process fluid body; [and]

wherein the second pump chamber comprises an actuation cavity defined by the second motive fluid plate and a second pump chamber cavity defined by the process fluid body;

*wherein the first pump chamber and the first inlet pressure-activated diaphragm valve are in fluid communication with the second outlet pressure-activated diaphragm valve via the first manifold, wherein the first manifold communicates a first motive fluid between the first pump chamber, the first inlet pressure-activated diaphragm valve and the second outlet pressure-activated diaphragm valve; and*

*wherein the second pump chamber and the second inlet pressure-activated diaphragm valve are in fluid communication with the first outlet pressure-activated diaphragm valve via the second manifold, wherein the second manifold communicates a second motive fluid between the second pump chamber, the second inlet pressure-activated diaphragm valve and the first outlet pressure-activated diaphragm valve.*

15. A pump for moving a process fluid, the pump comprising:

a process fluid body between a first motive fluid plate and a second motive fluid plate, a first inlet pressure-activated diaphragm valve, a first outlet pressure-activated diaphragm valve, a second inlet pressure-activated diaphragm valve and a second outlet pressure-activated diaphragm valve, wherein the first inlet pressure-activated diaphragm valve and the first outlet pressure-activated diaphragm valve are each defined by one of the motive fluid plates and the process fluid body while the second inlet pressure-activated diaphragm valve and the second outlet pressure-activated diaphragm valve are each defined by the other motive fluid plate and the process fluid body;

a first pump chamber and a second pump chamber, wherein the first pump chamber is defined by one of the motive fluid plates and the process fluid body define and second pump chamber is defined by the other motive fluid plate and the process fluid body;

*a first manifold formed in the pump;*

*a second manifold formed in the pump;* wherein the first pump chamber achieves fluid communication with an input line via the first inlet pressure-activated diaphragm valve and wherein the first pump chamber achieves fluid communication with an outlet line via the first outlet pressure-activated diaphragm valve;

wherein the second pump chamber achieves fluid communication with the input line via the second inlet pressure-activated diaphragm valve and wherein the second pump chamber achieves fluid communication with the outlet line via the second outlet pressure-activated diaphragm valve;

wherein a diaphragm is positioned in each pump chamber and each valve;

wherein the diaphragm in the first inlet valve and the diaphragm in the first pump chamber are simultaneously moved by a first motive fluid source; [and]

wherein the diaphragm in the second inlet valve and the diaphragm in the second pump chamber are simultaneously moved by a second motive fluid [source] *source;*

*wherein the first pump chamber and the first inlet pressure-activated diaphragm valve are in fluid communication with the second outlet pressure-activated diaphragm valve via the first manifold, wherein the first manifold communicates the first motive fluid between the first pump chamber, the first inlet pressure-activated diaphragm valve and the second outlet pressure-activated diaphragm valve; and*

*wherein the second pump chamber and the second inlet pressure-activated diaphragm valve are in fluid communication with the first outlet pressure-activated diaphragm valve via the second manifold, wherein the second manifold communicates the second motive fluid between the second pump chamber, the second inlet pressure-activated diaphragm valve and the first outlet pressure-activated diaphragm valve.*

16. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

a first motive fluid plate;

a second motive fluid plate; [and]

a process fluid body between the first motive fluid plate and the second motive fluid plate;

*a first manifold formed in the pump; and*

*a second manifold formed in the pump;* wherein the diaphragm of the first inlet pressure-activated diaphragm valve and the diaphragm of the first pump chamber are simultaneously moved by a first motive fluid;

wherein the diaphragm of the second inlet pressure-activated diaphragm valve and the diaphragm of the second pump chamber are simultaneously moved by a second motive fluid;

wherein the first inlet pressure-activated diaphragm valve and the first outlet pressure-activated diaphragm valve are both defined by the second motive fluid plate and the process fluid body; [and]

wherein the second inlet pressure-activated diaphragm valve and the second outlet pressure-activated diaphragm valve are both defined by the first motive fluid plate and the process fluid [body] *body;*

*wherein the first pump chamber and the first inlet pressure-activated diaphragm valve are in fluid communication with the second outlet pressure-activated diaphragm valve via the first manifold, wherein the first manifold communicates the first motive fluid between the first pump chamber, the first inlet pressure-activated diaphragm valve and the second outlet pressure-activated diaphragm valve; and*

*wherein the second pump chamber and the second inlet pressure-activated diaphragm valve are in fluid communication with the first outlet pressure-activated diaphragm valve via the second manifold, wherein the second manifold communicates the second motive fluid between the second pump chamber, the second inlet pressure-activated diaphragm valve and the first outlet pressure-activated diaphragm valve.*

17. A pump for moving a process fluid, the pump comprising:

a first inlet pressure-activated diaphragm valve, a first outlet pressure-activated diaphragm valve, a second inlet pressure-activated diaphragm valve, and a second outlet pressure activated diaphragm valve;

a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;

a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;

a first motive fluid plate;

a second motive fluid plate; [and]

a process fluid body between the first motive fluid plate and the second motive fluid plate;

*a first manifold formed in the pump; and*

*a second manifold formed in the pump;* wherein the diaphragm of the first inlet pressure-activated diaphragm valve and the diaphragm of the first pump chamber are simultaneously moved by a first motive fluid;

wherein the diaphragm of the second inlet pressure-activated diaphragm valve and the diaphragm of the second pump chamber are simultaneously moved by a second motive fluid;

wherein the first pump chamber comprises an actuation cavity defined by the first motive fluid plate and a first pump chamber cavity defined by the process fluid body; [and]

wherein the second pump chamber comprises an actuation cavity defined by the second motive fluid plate and a second pump chamber cavity defined by the process fluid [body] *body;*

*wherein the first pump chamber and the first inlet pressure-activated diaphragm valve are in fluid communication with the second outlet pressure-activated diaphragm valve via the first manifold, wherein the first manifold communicates the first motive fluid between the first pump chamber, the first inlet pressure-activated diaphragm valve and the second outlet pressure-activated diaphragm valve; and*

*wherein the second pump chamber and the second inlet pressure-activated diaphragm valve are in fluid communication with the first outlet pressure-activated diaphragm valve via the second manifold, wherein the second manifold communicates the second motive fluid between the second pump chamber, the second inlet pressure-activated diaphragm valve and the first outlet pressure-activated diaphragm valve.*

*18. The pump of claim 1, wherein the pump is a blood pump, the process fluid is blood, and the diaphragm of the first inlet pressure-activated diaphragm valve, the diaphragm of the first outlet pressure-activated diaphragm valve, the diaphragm of the first pump chamber and the diaphragm of the second pump chamber are separate diaphragms.*

*19. The pump of claim 13, wherein the first manifold comprises a plurality of first transfer passages and a plurality of first segments, each first transfer passage and each first segment formed in the pump, the plurality of first transfer passages and the plurality of first segments fluidly connecting the first pump chamber, the first inlet pressure-activated diaphragm valve and the second outlet pressure-activated diaphragm valve.*

*20. The pump of claim 19, wherein the plurality of first transfer passages and the plurality of first segments comprise:*

*a first transfer passage that fluidly connects the first pump chamber and the second outlet pressure-activated diaphragm valve;*

*a first segment that extends from the first pump chamber to the second outlet pressure-activated diaphragm valve;*

*a second transfer passage that fluidly connects the second outlet pressure-activated diaphragm valve to the first segment;*

*a second segment connected to and extending perpendicularly from the first segment; and*

*a third segment connected to and extending from the second segment, at least a portion of the third segment perpendicular to the first segment and the second segment, the third segment fluidly connecting the first pump chamber and the first inlet pressure-activated diaphragm valve.*

*21. The pump of claim 20, wherein each of the first and second transfer passages and the first and second segments is substantially parallel with the first motive fluid plate and the third segment extends through a thickness of the first motive fluid plate.*

*22. The pump of claim 13, wherein the second manifold comprises a plurality of first transfer passages and a plurality of first segments, each first transfer passage and each first segment formed in the pump, the plurality of first transfer passages and the plurality of first segments fluidly connecting the second pump chamber, the second inlet pressure-activated diaphragm valve and the first outlet pressure-activated diaphragm valve.*

*23. The pump of claim 22, wherein the plurality of first transfer passages and the plurality of first segments comprises:*

*a second transfer passage that fluidly connects the second pump chamber and the first outlet pressure-activated diaphragm valve;*

*a second segment that extends from the second pump chamber to the first outlet pressure-activated diaphragm valve;*

*a third transfer passage that fluidly connects the first outlet pressure-activated diaphragm valve to the second segment;*

*a third segment connected to and extending perpendicularly from the second segment; and*

*a fourth segment connected to and extending from the third segment, at least a portion of the fourth segment perpendicular to the second segment and the third segment, the fourth segment fluidly connecting the second pump chamber and the second inlet pressure-activated diaphragm valve.*

*24. The pump of claim 23, wherein each of the second and third transfer passages and the second and third segments is substantially parallel with the second motive fluid plate and the fourth segment extends through a thickness of the second motive fluid plate.*

*25. The pump of claim 14, wherein the first manifold comprises a plurality of first transfer passages and a plurality of first segments, each first transfer passage and each first segment formed in the pump, the plurality of first transfer passages and the plurality of first segments fluidly connecting the first pump chamber, the first inlet pressure-activated diaphragm valve and the second outlet pressure-activated diaphragm valve.*

*26. The pump of claim 25, wherein the plurality of first transfer passages and the plurality of first segments comprise:*

*a first transfer passage that fluidly connects the first pump chamber and the second outlet pressure-activated diaphragm valve;*

*a first segment that extends from the first pump chamber to the second outlet pressure-activated diaphragm valve;*

*a second transfer passage that fluidly connects the second outlet pressure-activated diaphragm valve to the first segment;*

*a second segment connected to and extending perpendicularly from the first segment; and*

*a third segment connected to and extending from the second segment, at least a portion of the third segment perpendicular to the first segment and the second segment, the third segment fluidly connecting the first pump chamber and the first inlet pressure-activated diaphragm valve.*

*27. The pump of claim 26, wherein each of the first and second transfer passages and the first and second segments is substantially parallel with the first motive fluid plate and the third segment extends through a thickness of the first motive fluid plate.*

*28. The pump of claim 14, wherein the second manifold comprises a plurality of first transfer passages and a plurality of first segments, each first transfer passage and each first segment formed in the pump, the plurality of first transfer passages and the plurality of first segments fluidly connecting the second pump chamber, the second inlet pressure-activated diaphragm valve and the first outlet pressure-activated diaphragm valve.*

*29. The pump of claim 28, wherein the plurality of first transfer passages and the plurality of first segments comprises:*

*a second transfer passage that fluidly connects the second pump chamber and the first outlet pressure-activated diaphragm valve;*

*a second segment that extends from the second pump chamber to the first outlet pressure-activated diaphragm valve;*

*a third transfer passage that fluidly connects the first outlet pressure-activated diaphragm valve to the second segment;*

*a third segment connected to and extending perpendicularly from the second segment; and*

*a fourth segment connected to and extending from the third segment, at least a portion of the fourth segment perpendicular to the second segment and the third segment, the fourth segment fluidly connecting the second pump chamber and the second inlet pressure-activated diaphragm valve.*

*30. The pump of claim 29, wherein each of the second and third transfer passages and the second and third segments is substantially parallel with the second motive fluid plate and the fourth segment extends through a thickness of the second motive fluid plate.*

*31. The pump of claim 15, wherein the first manifold comprises a plurality of first transfer passages and a plurality of first segments, each first transfer passage and each first segment formed in the pump, the plurality of first transfer passages and the plurality of first segments fluidly connecting the first pump chamber, the first inlet pressure-activated diaphragm valve and the second outlet pressure-activated diaphragm valve.*

*32. The pump of claim 31, wherein the plurality of first transfer passages and the plurality of first segments comprise:*

*a first transfer passage that fluidly connects the first pump chamber and the second outlet pressure-activated diaphragm valve;*

*a first segment that extends from the first pump chamber to the second outlet pressure-activated diaphragm valve;*

*a second transfer passage that fluidly connects the second outlet pressure-activated diaphragm valve to the first segment;*

*a second segment connected to and extending perpendicularly from the first segment; and*

*a third segment connected to and extending from the second segment, at least a portion of the third segment perpendicular to the first segment and the second segment, the third segment fluidly connecting the first pump chamber and the first inlet pressure-activated diaphragm valve.*

*33. The pump of claim 32, wherein each of the first and second transfer passages and the first and second segments is substantially parallel with the first motive fluid plate and the third segment extends through a thickness of the first motive fluid plate.*

*34. The pump of claim 15, wherein the second manifold comprises a plurality of first transfer passages and a plurality of first segments, each first transfer passage and each first segment formed in the pump, the plurality of first transfer passages and the plurality of first segments fluidly connecting the second pump chamber, the second inlet pressure-activated diaphragm valve and the first outlet pressure-activated diaphragm valve.*

*35. The pump of claim 34, wherein the plurality of first transfer passages and the plurality of first segments comprises:*

*a second transfer passage that fluidly connects the second pump chamber and the first outlet pressure-activated diaphragm valve;*

*a second segment that extends from the second pump chamber to the first outlet pressure-activated diaphragm valve;*

*a third transfer passage that fluidly connects the first outlet pressure-activated diaphragm valve to the second segment;*

*a third segment connected to and extending perpendicularly from the second segment; and*

*a fourth segment connected to and extending from the third segment, at least a portion of the fourth segment perpendicular to the second segment and the third segment, the fourth segment fluidly connecting the second pump chamber and the second inlet pressure-activated diaphragm valve.*

*36. The pump of claim 35, wherein each of the second and third transfer passages and the second and third segments is substantially parallel with the second motive fluid plate and the fourth segment extends through a thickness of the second motive fluid plate.*

*37. The pump of claim 16, wherein the first manifold comprises a plurality of first transfer passages and a plurality of first segments, each first transfer passage and each first segment formed in the pump, the plurality of first transfer passages and the plurality of first segments fluidly connecting the first pump chamber, the first inlet pressure-activated diaphragm valve and the second outlet pressure-activated diaphragm valve.*

*38. The pump of claim 37, wherein the plurality of first transfer passages and the plurality of first segments comprise:*

*a first transfer passage that fluidly connects the first pump chamber and the second outlet pressure-activated diaphragm valve;*

*a first segment that extends from the first pump chamber to the second outlet pressure-activated diaphragm valve;*

*a second transfer passage that fluidly connects the second outlet pressure-activated diaphragm valve to the first segment;*

*a second segment connected to and extending perpendicularly from the first segment; and*

*a third segment connected to and extending from the second segment, at least a portion of the third segment perpendicular to the first segment and the second segment, the third segment fluidly connecting the first pump chamber and the first inlet pressure-activated diaphragm valve.*

*39. The pump of claim 38, wherein each of the first and second transfer passages and the first and second segments is substantially parallel with the first motive fluid plate and the third segment extends through a thickness of the first motive fluid plate.*

*40. The pump of claim 16, wherein the second manifold comprises a plurality of first transfer passages and a plurality of first segments, each first transfer passage and each first segment formed in the pump, the plurality of first transfer passages and the plurality of first segments fluidly connecting the second pump chamber, the second inlet pressure-activated diaphragm valve and the first outlet pressure-activated diaphragm valve.*

*41. The pump of claim 40, wherein the plurality of first transfer passages and the plurality of first segments comprises:*

*a second transfer passage that fluidly connects the second pump chamber and the first outlet pressure-activated diaphragm valve;*

*a second segment that extends from the second pump chamber to the first outlet pressure-activated diaphragm valve;*

*a third transfer passage that fluidly connects the first outlet pressure-activated diaphragm valve to the second segment;*

*a third segment connected to and extending perpendicularly from the second segment; and*

*a fourth segment connected to and extending from the third segment, at least a portion of the fourth segment perpendicular to the second segment and the third segment, the fourth segment fluidly connecting the second pump chamber and the second inlet pressure-activated diaphragm valve.*

*42. The pump of claim 41, wherein each of the second and third transfer passages and the second and third segments is substantially parallel with the second motive fluid plate and the fourth segment extends through a thickness of the second motive fluid plate.*

*43. The pump of claim 17, wherein the first manifold comprises a plurality of first transfer passages and a plurality of first segments, each first transfer passage and each first segment formed in the pump, the plurality of first transfer passages and the plurality of first segments fluidly connecting the first pump chamber, the first inlet pressure-activated diaphragm valve and the second outlet pressure-activated diaphragm valve.*

*44. The pump of claim 43, wherein the plurality of first transfer passages and the plurality of first segments comprise:*

*a first transfer passage that fluidly connects the first pump chamber and the second outlet pressure-activated diaphragm valve;*

*a first segment that extends from the first pump chamber to the second outlet pressure-activated diaphragm valve;*

*a second transfer passage that fluidly connects the second outlet pressure-activated diaphragm valve to the first segment;*

*a second segment connected to and extending perpendicularly from the first segment; and*

*a third segment connected to and extending from the second segment, at least a portion of the third segment perpendicular to the first segment and the second segment, the third segment fluidly connecting the first pump chamber and the first inlet pressure-activated diaphragm valve.*

*45. The pump of claim 44, wherein each of the first and second transfer passages and the first and second segments is substantially parallel with the first motive fluid plate and the third segment extends through a thickness of the first motive fluid plate.*

*46. The pump of claim 17, wherein the second manifold comprises a plurality of first transfer passages and a plurality of first segments, each first transfer passage and each first segment formed in the pump, the plurality of first transfer passages and the plurality of first segments fluidly connecting the second pump chamber, the second inlet pressure-activated diaphragm valve and the first outlet pressure-activated diaphragm valve.*

*47. The pump of claim 46, wherein the plurality of first transfer passages and the plurality of first segments comprises:*

*a second transfer passage that fluidly connects the second pump chamber and the first outlet pressure-activated diaphragm valve;*

*a second segment that extends from the second pump chamber to the first outlet pressure-activated diaphragm valve;*

*a third transfer passage that fluidly connects the first outlet pressure-activated diaphragm valve to the second segment;*

*a third segment connected to and extending perpendicularly from the second segment; and*

*a fourth segment connected to and extending from the third segment, at least a portion of the fourth segment perpendicular to the second segment and the third segment, the fourth segment fluidly connecting the second pump chamber and the second inlet pressure-activated diaphragm valve.*

*48. The pump of claim 47, wherein each of the second and third transfer passages and the second and third segments is substantially parallel with the second motive fluid plate and the fourth segment extends through a thickness of the second motive fluid plate.*

*49. A pump for moving a process fluid, the pump comprising:*

*a first inlet pressure-activated diaphragm valve, a first outlet pressure-activated diaphragm valve, a second inlet pressure-activated diaphragm valve, and a second outlet pressure activated diaphragm valve;*

*a first pump chamber comprising a pressure-activated diaphragm, wherein the first pump chamber achieves fluid communication with an input line via the first inlet pressure-activated diaphragm valve, and wherein the first pump chamber achieves fluid communication with an outlet line via the first outlet pressure-activated diaphragm valve;*

*a second pump chamber comprising a pressure-activated diaphragm, wherein the second pump chamber achieves fluid communication with the input line via the second inlet pressure-activated diaphragm valve, and wherein the second pump chamber achieves fluid communication with the outlet line via the second outlet pressure-activated diaphragm valve;*

*a first manifold formed in the pump; and*

*a second manifold formed in the pump;*

*wherein the diaphragm of the first inlet pressure-activated diaphragm valve and the diaphragm of the first pump chamber are simultaneously moved by a first motive fluid;*

*wherein the diaphragm of the second inlet pressure-activated diaphragm valve and the diaphragm of the second pump chamber are simultaneously moved by a second motive fluid;*

*wherein the first pump chamber and the first inlet pressure-activated diaphragm valve are in fluid communication with the second outlet pressure-activated diaphragm valve via the first manifold, wherein the first manifold communicates the first motive fluid between the first pump chamber, the first inlet pressure-activated diaphragm valve and the second outlet pressure-activated diaphragm valve; and*

*wherein the second pump chamber and the second inlet pressure-activated diaphragm valve are in fluid communication with the first outlet pressure-activated diaphragm valve via the second manifold, wherein the second manifold communicates the second motive fluid between the second pump chamber, the second inlet pressure-activated diaphragm valve and the first outlet pressure-activated diaphragm valve.*

*50. The pump of claim 49, wherein the first manifold comprises a plurality of first transfer passages and a plurality of first segments, each first transfer passage and each first segment formed in the pump, the plurality of first transfer passages and the plurality of first segments fluidly connecting the first pump chamber, the first inlet pressure-activated diaphragm valve and the second outlet pressure-activated diaphragm valve.*

*51. The pump of claim 50, wherein the plurality of first transfer passages and the plurality of first segments comprise:*

*a first transfer passage that fluidly connects the first pump chamber and the second outlet pressure-activated diaphragm valve;*

*a first segment that extends from the first pump chamber to the second outlet pressure-activated diaphragm valve;*

*a second transfer passage that fluidly connects the second outlet pressure-activated diaphragm valve to the first segment;*

*a second segment connected to and extending perpendicularly from the first segment; and*

*a third segment connected to and extending from the second segment at least a portion of the third segment perpendicular to the first segment and the second segment, the third segment fluidly connecting the first pump chamber and the first inlet pressure-activated diaphragm valve.*

*52. The pump of claim 50, wherein the second manifold comprises a plurality of second transfer passages and a plurality of second segments, each second transfer passage and each second segment formed in the pump, the plurality of second transfer passages and the plurality of second segments fluidly connecting the second pump chamber, the sec-*

*ond inlet pressure-activated diaphragm valve and the first outlet pressure-activated diaphragm valve.*

*53. The pump of claim 52, wherein the plurality of second transfer passages and the plurality of second segments comprises:*

*a third transfer passage that fluidly connects the second pump chamber and the first outlet pressure-activated diaphragm valve;*

*a third segment that extends from the second pump chamber to the first outlet pressure-activated diaphragm valve;*

*a fourth transfer passage that fluidly connects the first outlet pressure-activated diaphragm valve to the third segment;*

*a fourth segment connected to and extending perpendicularly from the third segment; and*

*a fifth segment connected to and extending from the fourth segment at least a portion of the fifth segment perpendicular to the third segment and the fourth segment the fifth segment fluidly connecting the second pump chamber and the second inlet pressure-activated diaphragm valve.*

*54. The pump of claim 52, further comprising a first motive fluid plate, a second motive fluid plate, and a process fluid body between the first motive fluid plate and the second motive fluid plate, wherein each of the first manifold and the second manifold is formed in the first motive fluid plate, the second motive fluid plate and the process fluid body.*

*55. The pump of claim 54, wherein each of the first and second transfer passages and the first and second segments is substantially parallel with the first motive fluid plate and a third segment extends through a thickness of the first motive fluid plate.*

*56. The pump of claim 54, wherein each of a third and fourth transfer passage and a third and a fourth segment is substantially parallel with the second motive fluid plate and a fifth segment extends through a thickness of the second motive fluid plate.*

*57. The pump of claim 49, wherein the first pump chamber has a first recess configuration to distribute pressure to the pressure-activated diaphragm comprised in the first pump chamber.*

*58. The pump of claim 57, wherein the first pump chamber comprises a first actuation cavity and a first pump chamber cavity, wherein the first recess configuration comprises a plurality of recesses positioned within a cavity surface of the first actuation cavity.*

*59. The pump of claim 58, wherein the cavity surface is at a center of the first recess configuration.*

*60. The pump of claim 49, wherein the second pump chamber has a second recess configuration to distribute pressure to the pressure-activated diaphragm comprised in the second pump chamber.*

*61. The pump of claim 60, wherein the second pump chamber comprises a second actuation cavity and a second pump chamber cavity, wherein the second recess configuration comprises a plurality of recesses positioned within a cavity surface of the second actuation cavity.*

*62. The pump of claim 61, wherein the cavity surface is at a center of the second recess configuration.*

*63. The pump of claim 49, wherein each of the first inlet pressure-activated diaphragm valve and the first outlet pressure-activated diaphragm valve comprises a respective recess configuration to distribute pressure to the respective pressure-activated diaphragm.*

*64. The pump of claim 63, wherein each recess configuration includes a pair of linear recess features opposite from each other and separated by a circular recess feature.*

*65. The pump of claim 49, wherein each of the second inlet pressure-activated diaphragm valve and the second outlet pressure-activated diaphragm valve comprises a respective recess configuration to distribute pressure to the respective pressure-activated diaphragm.*

*66. The pump of claim 65, wherein each recess configuration includes a pair of linear recess features opposite from each other and separated by a circular recess feature.*

*67. The pump of claim 49, wherein the first pump chamber has a recess configuration to distribute pressure to the first pressure-activated diaphragm comprised in the first pump chamber, wherein each of the first inlet pressure-activated diaphragm valve and the first outlet pressure-activated diaphragm valve comprises a respective recess configuration to distribute pressure to the respective pressure-activated diaphram, wherein the recess configuration of the first pump chamber is larger than the recess configuration of each of the first inlet pressure-activated diaphragm valve and the first outlet pressure-activated diaphragm valve.*

*68. The pump of claim 49, wherein the second pump chamber has a recess configuration to distribute pressure to the second pressure-activated diaphragm comprised in the second pump chamber, wherein each of the second inlet pressure-activated diaphragm valve and the second outlet pressure-activated diaphragm valve comprises a respective recess configuration to distribute pressure to the respective pressure-activated diaphragm, wherein the recess configuration of the second pump chamber is larger than the recess configuration of each of the second inlet pressure-activated diaphragm valve and the second outlet pressure-activated diaphragm valve.*

*69. The pump of claim 49, wherein the first pump chamber comprises a first actuation cavity and a first pump chamber cavity, wherein the first pump chamber cavity comprises an inclined region and a rim.*

*70. The pump of claim 69, wherein a transition from the inclined region to the rim is rounded.*

*71. The pump of claim 49, wherein the second pump chamber comprises a second actuation cavity and a second pump chamber cavity, wherein the second pump chamber cavity comprises an inclined region and a rim.*

*72. The pump of claim 71, wherein a transition from the inclined region to the rim is rounded.*

* * * * *